US005572189A

United States Patent [19]

Yamamoto et al.

[11] Patent Number: 5,572,189

[45] Date of Patent: Nov. 5, 1996

[54] ALARM COLLECTION APPARATUS OF CENTRAL MAINTENANCE OPERATION CENTER

[75] Inventors: Kunio Yamamoto, Kawasaki; Nobuhiko Eguchi; Hidetaka Nishi, both of Fukuoka, all of Japan

[73] Assignee: Fujitsu Ltd., Kawasaki, Japan

[21] Appl. No.: 25,316

[22] Filed: Mar. 2, 1993

[30] Foreign Application Priority Data

Mar. 2, 1992 [JP] Japan ..... 4-044548

[51] Int. Cl.[6] ..... G08B 29/00

[52] U.S. Cl. ..... 340/506; 340/505; 340/517; 361/797; 455/53.1; 379/244

[58] Field of Search ..... 340/505, 506, 340/517, 53 P; 361/796, 797, 802; 379/243, 244; 455/33.1, 54.1, 53.1

[56] References Cited

U.S. PATENT DOCUMENTS

| | | | |
|---|---|---|---|
| 3,815,093 | 6/1974 | Caretto et al. | 340/505 |
| 4,334,261 | 6/1982 | Gonzales | 361/802 |
| 4,724,538 | 2/1988 | Farrell | 340/539 |
| 4,954,809 | 9/1990 | Right et al. | 340/505 |
| 5,055,851 | 10/1991 | Sheffer | 340/539 |
| 5,134,644 | 7/1992 | Garton et al. | 340/539 |

*Primary Examiner*—Jeffrey Hofsass
*Assistant Examiner*—Daniel J. Wu
*Attorney, Agent, or Firm*—Staas & Halsey

[57] ABSTRACT

An alarm collection apparatus for use in an exchange system has a plurality of local offices, a central maintenance office, a toll switch, and an alarm link. The local offices include an enhanced local office and a conventional local office, the enhanced local office having enhanced features with respect to the number of alarm collection points, a display function thereof, and a man-machine alarms interface. An alarm collection shelf collects alarm information from the conventional local office in the same manner as from the enhanced local office, by converting the data format used for the conventional office to one which corresponds to the data format used for the enhanced office. The alarm collection shelf also collects alarms from a radio base office.

12 Claims, 39 Drawing Sheets

FIG. 13A

PLODO

| LOCAL OFFICE ID No. | ( 0 ~ 255 ) |
|---|---|
| $80 | |
| $00 | |
| $00 | |

FIG. 13B

STRQO

| LOCAL OFFICE ID No. | ( 0 ~ 255 ) |
|---|---|
| $81 | |
| $00 | |

FIG. 14

ALMDA (ANSWER FROM Almsh - B)

| | $b_7$ | $b_6$ | $b_5$ | $b_4$ | $b_3$ | $b_2$ | $b_1$ | $b_0$ | |
|---|---|---|---|---|---|---|---|---|---|
| 0 | LOCAL OFFICE ID No. (0 ~ 255) | | | | | | | | |
| 1 | $A7 | | | | | | | | |
| 2 | $00 | | | | | | | | |
| 3 | NUMBER OF CPR ($00 ~ $08) | | | | | | | | |
| 4 | | | | IO | | CP | ESE | REM | (CP SYSTEM ALARM EXISTS/DOES NOT EXIST) |
| | | | | | | | FAN | PW | (SCF ALARM CONTENTS) |
| | CP7 | CP6 | CP5 | CP4 | CP3 | CP2 | CP1 | MPR | (REPEATED EMERGENCY) |
| | | | | | | | | CP8 | |
| | CP7 | CP6 | CP5 | CP4 | CP3 | CP2 | CP1 | MPR | (ESE EMERGENCY) |
| | | | | | | | | CP8 | |
| | CP7 | CP6 | CP5 | CP4 | CP3 | CP2 | CP1 | MPR | (CP ALARM) |
| | | | | | | | | CP8 | |
| | | | | | | | | | |
| | | | | | | | | | |
| | CP7 | CP6 | CP5 | CP4 | CP3 | CP2 | CP1 | MPR | (IO ALARM) |
| 15 | | | | | | | | CP8 | |
| 16 | POS | LTCN | ANM | ALIP | SYNC | RCLK | | PW | (SP/MISC MAJOR ALARM) |
| | | | | | | | | | |
| | | | | FIR | HUM | TPL | TPH | AIRC | |
| 19 | | SP3 | SP2 | SP1 | SP0 | | | | |
| | | | | | | | | | |
| 20 | | | | | | | | | (HARD MINOR ALARM) |
| 21 | | SP1 | SP0 | | | | | DOR | |
| 22 | | | | | | PDC | RNG | ADF | (POWER ALARM) |
| 23 | | SP1 | SP0 | | | INV | RECT | CAC | |
| 1 24 | | | | | | SWN | SMN | SMJ | (SOFTWARE ALARM) |
| 25 | | | | | | | | INV | INV: MODE OF INVERTER |
| 26 | MATE OFFICE ID CODE (0 ~ 255) | | | | | | | | (MATE OFFICE ALARM) |
| 27 | | | | | | SPR | SYD | ALB | |
| 2 28 | PWR | ENVR | EQP | OSYS | | HMN | HMJ | PW | (HARDWARE ALARM) |
| 29 | | | BO | BS | | | | | (ALARM BELL STATUS) |
| 3 30 | TPE | PRST | OSF | CCOL | CRT | LCO | RBY | RTR | (SOFTWARE STATUS INFORMATION) |
| 31 | | | | | | | | | |
| 32 | | | | | | | PLC | ASH | |
| 33 | | | | | | | | | |
| 59 | | | | | | | | | |

FIG. 15 ALMDA (ANSWER FROM stcns)

| | $b_7$ | $b_6$ | $b_5$ | $b_4$ | $b_3$ | $b_2$ | $b_1$ | $b_0$ | |
|---|---|---|---|---|---|---|---|---|---|
| 0 | LOCAL OFFICE ID No. (0 ~ 255) | | | | | | | | |
| 1 | $A7 | | | | | | | | |
| 2 | $00 | | | | | | | | |
| 3 | NUMBER OF CPR ($00 ~ $08) | | | | | | | | |
| 4 | | | | IO | FMF | CP | ESE | REM | (CP SYSTEM ALARM EXISTS/DOES NOT EXIST) |
| | | | | | | | FAN | PW | (SCP ALARM CONTENTS) |
| | CP7 | CP6 | CP5 | CP4 | CP3 | CP2 | CP1 | MPR | (REPEATED EMERGENCY) |
| | | | | | | | | CP8 | |
| | CP7 | CP6 | CP5 | CP4 | CP3 | CP2 | CP1 | MPR | (ESE EMERGENCY) |
| | | | | | | | | CP8 | |
| | CP7 | CP6 | CP5 | CP4 | CP3 | CP2 | CP1 | MPR | (CP ALARM) |
| | | | | | | | | CP8 | |
| | CP7 | CP6 | CP5 | CP4 | CP3 | CP2 | CP1 | MPR | (FMF ALARM) |
| | | | | | | | | CP8 | |
| | CP7 | CP6 | CP5 | CP4 | CP3 | CP2 | CP1 | MPR | (IO ALARM) |
| 15 | | | | | | | | CP8 | |
| 16 | POS | LTCN | ANM | ALIP | SYNC | RCLK | FAN | PW | (SP/MISC MAJOR ALARM) |
| | | | | | | | | SCLK | |
| | | | | FIR | HUM | TPL | TPH | AIRC | |
| 19 | | /SP3 | /SP2 | /SP1 | /SP0 | | | | |
| | | | | | | | | | |
| 20 | | | | | | | TMOVN | | (HARD MINOR ALARM) |
| 21 | | /SP1 | /SP0 | | | | | DOR | |
| 22 | | | | | | PDC | RNG | ADF | (POWER ALARM) |
| 23 | | /SP1 | /SP0 | | | INV | RECT | CAC | |
| ① 24 | | | | | | SWN | SMN | SMJ | (SOFTWARE ALARM) |
| 25 | | | | | | | | INV | INV: MODE OF INVERTER |
| 26 | MATE OFFICE ID CODE (00 ~ 255) | | | | | | | | (MATE OFFICE ALARM) |
| 27 | | | | | | SPR | SYD | ALE | |
| 28 | | | | | | | | | |
| 29 | | | | | | | | | |
| 30 | | | | | | | | | |
| 31 | | | | | | | | | |

FIG. 16

STSDA

| | | | | |
|---|---|---|---|---|
| 0 | LOCAL OFFICE ID NO. (0 ~ 255) | | | |
| 1 | $A1 | | | |
| 2 | $00 | | | |
| 3 | NUMBER OF CPR | | | |
| 4 | MPR ~ CC OCCUPANCY (BCD 00 ~ 99) | | | |
| 5 | CPR 1 ~ CPR 7 CC OCCUPANCY | | | |
| ~ | | | | |
| 12 | CPR 8 - CC OCCUPANCY | | | |
| 13 | | | MT 2 | MT 0 |
| | | | MT 3 | MT 1 |
| | | | | |
| 16 | | | | |
| 17 | CHC2 | CHC0 | SYSTEM MM 0 | CC 0 |
| | CHC3 | CHC1 | SYSTEM MM 1 | CC 1 |
| | | | FM 2 | FM 0 |
| | | | FM 3 | FM 1 |
| | MCCA40 | 30 | 20 | MCCA10 |
| | MCCA41 | 31 | 21 | MCCA11 |
| | MCCA80 | 70 | 60 | MCCA50 |
| 24 | MCCA81 | 71 | 61 | MCCA51 |
| 25 | CHC2 | CHC0 | SYSTEM MM 0 | CC 0 |
| | CHC3 | CHC1 | SYSTEM MM 1 | CC 1 |
| | | CCA0 | FM 2 | FM 0 |
| | | CCA1 | FM 3 | FM 1 |
| | NW 30 | NW 20 | NW 10 | NW 00 |
| | NW 31 | NW 21 | NW 11 | NW 01 |
| | NW 70 | NW 60 | NW 50 | NW 40 |
| | NW 71 | NW 61 | NW 51 | NW 41 |
| | NW 110 | NW 100 | NW 90 | NW 80 |
| | NW 111 | NW 101 | NW 91 | NW 81 |
| | NW 150 | NW 140 | NW 130 | NW 120 |
| 36 | NW 151 | NW 141 | NW 131 | NW 121 |
| 37 ~ 120 | CPR2 ~ CPR8 STATUS ( CONTENTS OF DATA ARE SAME AS THOSE OF CPR 1 STATUS ) | | | |

STCNS = "0", ALMCU = "1"

| | |
|---|---|
| | UNI=0, MULTI=1~8 |
| COLUMN OF 10 | COLUMN OF 1 |

$b_7$ $b_6$ $b_5$ $b_4$ $b_3$ $b_2$ $b_1$ $b_0$

NOT INSTALLED : 00
ACTIVE : 01
STAND-BY : 10
OUT OF SERVICE : 11

COMMON UNIT STATUS

MPR STATUS

CPR1 STATUS

INTR: ALMS INITIALIZATION REQUESTED REQUESTED = "1"

MPR (SOFTWARE) INITIALIZES BY SENDING INITIALIZATION DATA LCLID (LOCAL OFFICE ID INFORMATION) AND ALMACT (SWITCHING OF SYSTEM ALMS INF) TO ALMS INF WHEN INTR IS "1".

FIG. 34A

| ORDER CODE | CONTENTS | ANSWER |
|---|---|---|
| POLO | SV IS REQUIRED FOR ALARM INFORMATION | SVRLT NODATA |

FIG. 34B

DATA IN INFORMATION DIVISION (BIT P IN CONTROL DIVISION IS SET TO 1)

| COMMUNICATION IDENTIFICATION CODE | EXTENSION DIVISION | SOURCE ADDRESS | DESTINATION ADDRESS | DATA LENGTH | DATA |
|---|---|---|---|---|---|
| 01 (H) | 00 (H) | 01 (H) 00 (H) | 02 ~ 21 (H) OF (H) | 00 (H) 0 (H) | 00 (H) 00 (H) |

FIG. 35A

SVRLT (MONITOR RESULT)

| ORDER CODE | CONTENTS | ORDER |
|---|---|---|
| SVRLT | MONITOR RESULT FROM SV | POLO |

FIG. 35B

DATA IN INFORMATION DIVISION (BIT F OF CONTROL DIVISION INDICATES "1")

| COMMUNICATION IDENTIFICATION CODE | EXTENSION DIVISION | SOURCE ADDRESS | DESTINATION ADDRESS | DATA LENGTH | DATA |
|---|---|---|---|---|---|
| 02 (H) | ** (H) ( NOTE 1 ) | 02 ~ 21 (H) 00 (H) | 01 (H) 00 (H) | 00 (H) 10 (H) | MONITOR RESULT (NOTE 2) |

NOTE 1: EXTENSION DIVISION

FIG. 35C

| 1 | | | | | | | | | | | 16 | | | | | | | | |
|---|---|---|---|---|---|---|---|---|---|---|---|---|---|---|---|---|---|---|---|
| $b_7$ | $b_6$ | $b_5$ | $b_4$ | $b_3$ | $b_2$ | $b_1$ | $b_0$ | $b_7$ | $b_6$ | | $b_0$ | $b_7$ | $b_6$ | $b_5$ | $b_4$ | $b_3$ | $b_2$ | $b_2$ | $b_1$ | $b_0$ |
| ITEM 8 | ITEM 7 | ITEM 6 | ITEM 5 | ITEM 4 | ITEM 3 | ITEM 2 | ITEM 1 | ITEM 16 | ITEM 15 | | ITEM 120 | ITEM 128 | ITEM 127 | ITEM 126 | ITEM 125 | ITEM 124 | ITEM 123 | ITEM 122 | ITEM 121 |

FIG. 36A

MONITOR ITEMS UNUSED POINTS ARE MARKED "0"

1 ~ 96: EQUIPMENTS IN BASE OFFICE, 97 ~ 105: RECTIFIER/BATTERY, 106 ~ 128 (COMMUNICATIONS UNIT)

| ITEM No. | MONITOR ITEMS | STAGE | | REMARKS |
|---|---|---|---|---|
| | | 0 (CLOSE) | 1 (CLOSE) | |
| 1 | LEAKAGE OF WATER | NORMAL | LEAKAGE DETECTED | |
| 2 | OPEN DOOR | CLOSED DOOR | OPEN DOOR | ALL DOORS (4): OR |
| 3 | IN OPERATION | ——————— | WORKER PRESENT IN LOCAL OFFICE | HALOGEN AUTO-MATIC MANUAL SWITCH SIGNAL |
| 4 | FAN OPERATED/STOPPED (IN COMMUNICATIONS SYS-TEM ROOM) | FAN STOPPED | FAN OPERATED | |
| 5 | FAN OPERATED/STOPPED IN BATTERY ROOM | FAN STOPED | FAN OPERATED | |
| 6 | FIRE DETECTED | NORMAL | FIRE ALARM IN OPERATION | |
| 7 | EXTINGUISHING OPERATION (AUTOMATIC/MANUAL) | EXTINGUISHING SW SWITCH TO "AUTO-MATIC" | EXTINGUISHING SW SWITCH TO "MANUAL" | |
| 8 | DEFECTIVE EXTINGUISHING | NORMAL | DEFECTIVE EXTINGUISHING | |
| 9 | EXTINGUISHING GAS DISCHARGED | EXTINGUISHING GAS NOT DISCHARGED | EXTINGUISHING GAS DISCHARGED | DISCHARED IN 20 SECONDS AFTER ACTIVATION |
| 10 | EXTINGUISHING GAS LEAKAGE | NO LEAKAGE OF EXTINGUISHING GAS | EXTINGUISHING GAS LEAKAGE | DEPENDING ON OFFICE |
| 11 | AC DISTRIBUTION PANEL (IN-PUT OF MCB DISCONNECTED AC 200V) | NORMAL | AC 200V DISCONNECTED | |
| 12 | AC DISTRIBUTION PANEL (IN-PUT OF MCB DISCONNECTED AC 100V) | NORMAL | AC 100V DISCONNECTED | |
| 13 | AC DISTRIBUTION PANEL (IN-PUT OF MCB DISCONNECTED INV) | NORMAL | INPUT OF INV DISCONNECTED | |
| 14 | AC DISTRIBUTION PANEL (OUTPUT OF MCB DISCON-NECTED RECTIFIER) | NORMAL | OUTPUT OF RECTIFIER DISCONNECTED | |
| 15 | AC DISTRIBUTION PANEL (OUTPUT OF MCB DIS-CONNECTED HALOGEN) | NORMAL | EXTINGUISHING POWER SOURCE DISCONNECTED | |
| 16 | AC DISTRIBUTION PANEL MCB DISCONNECTED (AIR-CONDITIONER) | NORMAL | AIR-CONDITIONER POWER SOURCE DISCONNECTED | |
| 17 | AC DISTRIBUTION PANEL MCB DISCONNECTED (FAN IN COMMUNICATION ROOM) | NORMAL | COMMUNICATION ROOM FAN POWER SOURCE DISCONNECTED | |
| 18 | AC DISTRIBUTION PANEL MCB DISCONNECTED (FAN IN BATTERY ROOM) | NORMAL | BATTERY ROOM FAN POWER SOURCE DISCONNECTED | |

TO FIG. 36B

FIG. 36B

FROM FIG. 36A

| | | | | |
|---|---|---|---|---|
| 19 | AC DISTRIBUTION PANEL MCB DISCONNECTED (CONTROL CIRCUIT) | NORMAL | LOCAL OFFICE MONITOR ROOM POWER SOURCE DISCONNECTED | |
| 20 | AC DISTRIBUTION PANEL AC 200V ABNORMAL | NO ABNORMAL ALARM FOR AC 200V | ABNORMAL ALARM FOR AC 200V | |
| 21 | AC DISTRIBUTION PANEL AC 100V ABNORMAL | NO ABNORMAL ALARM FOR AC 100V | ABNORMAL ALARM FOR AC 100V | |
| 22 | INVERTER OPERATED/ STOPPED | OPERATED | STOPPED | |
| 23 | INVERTER ABNORMAL | NORMAL | ABNORMAL | |
| 24 | AIR-CONDITIONER OPERATED/STOPPED | STOPPED | OPERATED | |
| 25 | AIR-CONDITIONER IN FAULT | NORMAL | ABNORMAL | |
| 26 | ABNORMAL TEMPERATURE IN COMMUNICATION ROOM (HIGH TEMPERATURE) | ROOM TEMPERATURE LOWER THAN αC° | ROOM TEMPERATURE HIGHER THAN αC° | α = 48 (RESETTABLE) |
| 27 | ABNORMAL TEMPERATURE IN BATTERY ROOM (HIGH TEMPERATURE) | ROOM TEMPERATURE LOWER THAN αC° | ROOM TEMPERATURE HIGHER THAN αC° | α = 48 (RESETTABLE) |
| 28<br>29 | | | | |
| 30<br>31 | | | | |
| 32 | | | | |

* 1: OPEN DOOR ALARM IS CUT OFF BY OMC IF OPERATION IS STARTED.

ALARM COLLECTION APPARATUS OF CENTRAL MAINTENANCE OPERATION CENTER

BACKGROUND OF THE INVENTION

1. Field of the Invention

The present invention relates to an alarm collection apparatus of a central maintenance operation center for use in exchange, and in particular to an alarm collection apparatus with flexibility to enhanced functional extensions of the exchange.

2. Description of the Related Art

FIG. 1A is a block diagram showing the construction of a conventional alarm signaling system which is used in an exchange, such as a FETEX-150 provided by the assignee of the present invention.

The conventional exchange system comprises a plurality of local offices (or stations) 910, a remote line concentrator (RLC) 930, a central maintenance operation center (CMOC) 940, and a toll switch (TS) 950. The CMOC 940 supervises occurrences of alarms at the local offices 910. The TS 950 is a switching office and is disposed between the CMOC 940 and the local office 910. The RLC 930 is a remote exchange which is a satellite of a local office and comprises a subscriber line circuit (SLC) 931 and a remote line concentrator (RLC) 932.

The local office 910 comprises a subscriber line circuit (SLC) 911, a line concentrator (LC) 912, and a network (NW) 913 which are connected one after the other. The NW 913 is connected to a main processor and call processor (MPR/CPR) 914. The MPR/CPR 914 is connected to a visual display unit (VDU) 915 which comprises a display and a command entry key set. The NW 913 is connected to a system test console (STCNS) 916 through common channel signaling equipment (CSEI) 919 and a console interface (CN) 920 which are network interfaces. The STCNS 916 collects alarms of the local office. In the RLC 930, the RLC 932 is connected to the SLC 931. The RLC 932 is accommodated in the network NW 913 of the local office 910.

The CMOC 940 comprises a digital link interface (DLI) 941, a master system test console (MSTCNS) 942, a system supervisory console (SSCNS) 943, a main processor (MPR) 944, and a visual display unit (VDU) 945. The DLI 941 is a switch unit. The MSTCNS 942 is a console which collects alarms of the local office 910. The SSCNS 943 performs control processes such as setting a path for the DLI 941 and collecting and displaying alarms detected by the CMOC 940. The VDU 945 comprises a display and a dedicated key set. The DLI 941 has a controller (CNT) 954 which controls the switch unit. The SSCNS 943 is connected to an alarm indicator (ALIND) 946 and alarm display equipment (ALDE) 947. Under the control of the SSCNS 943, the ALDE 947 displays the positions of local offices 910 and alarms thereof by using a map.

The local office 910 and the CMOC 940 are connected through the TS 950 which is a switching office. Alarm information is sent from the local office 910 to the CMOC 940 through an alarm collection link. The STCNS 916 of the local office 910 communicates with the MSTCNS 942 of the CMOC 940 through a common channel signaling equipment interface (CSEI) and a digital terminal (DT). An alarm link 960 is formed of the STCNS 916, the CSEI 919-1, the NW 913, the DT 921-1, the DT 951-1, the TS 950, the DT 951-2, the DT 948-1, the DLI 941, the CSEI 949-1, and the MSTCNS 942. On the other hand, the MPR 914 of the local office 910 is linked to the MPR 944 of the CMOC 940 in accordance with common channel signaling method No. 7. A No. 7 link 965 is formed of the MPR/CPR 914, common channel signaling equipment (CSE) 922, the CSEI 919-2, the NW 913, the DT 921-2, the DT 951-3, the DT 951-4, the DT 948-2, the DLI 941, the CSEI 949-2. the CSE 953, and the MPR 944.

An alarm detected (by hardware) in the local office 910 is sent to the MPR/CPR 914 through the NW 913. A relevant alarm message is displayed on both the VDU 915 and the STCNS 916. The alarm message is sent to the MSTCNS 942 from the STCNS 916 through the alarm link 960. The alarm message is displayed on the display of the MSTCNS 942.

The STCNS 916 of the local office 910 has an alarm input terminal which directly receives an alarm. An alarm that the STCNS 916 has directly received is displayed on the STCNS 916. The alarm is also displayed on the MSTCNS 942 through the alarm link 960.

Some alarms are detected by software. In other words, errors in software are recognized by the MPR/CPR 914. The MPR/CPR 914 sends a relevant message to the VDU 915. As well as a system status, a software alarm is displayed on the STCNS 916 and sent to the MSTCNS 942 through the alarm link 960. As examples of system statuses, there are duplex system active/inactive (inactive meaning standby) status, route status, busy status, call regulation status, CC occupying ratio, and CC overload. The MPR/CPR 914 sends to the MPR 944 of the CMOC 940 through the No. 7 link 965 a software alarm message displayed on the VDU 915. Thus, the alarm message is also displayed on the VDU 945 of the CMOC 940. When a command is input from the dedicated key set of the VDU 915, this command is sent to the VDU 945 of the CMOC 940 through the NO. 7 link 965.

As described above, between the local office 910 and the CMOC 940, two links, namely the alarm link 960 and the No. 7 link 965, are provided. In the conventional system, the alarm link 960 serves to send alarm information and status information, whereas the No. 7 link 965 serves to send messages.

However, the above-described exchange system (FETEX-150) will be extended as technologies of hardware and software are advancing. Thus, problems with respect to alarm collection are arising.

On the local office side, the conventional system has the following problems:

(1) Cannot handle an increase of the number of alarm points . . . As the system advances, the number of alarm points to be supervised increases. However, the hardware and firmware of the STCNS in the conventional system restrict an increase of the number of alarm points accessible.

(2) Cannot flexibly add or change new alarm points. . . . After the system has been installed and operated, the system will be enhanced on the user side. For example, units A and B which have been installed may be replaced with different units α, δ, and ***. Thus, after the system has been installed and operated, it is preferred to easily add or change alarm points. However, the STCNS cannot flexibly add or change new points.

(3) Cannot provide an adequate man-machine interface. . . . In the conventional system, alarms and so forth are displayed on the display of the STCNS. Thus, the hardware and firmware of the console should perform the display process. In other words, the conventional system cannot provide the user with a flexible man-machine interface.

To solve such problems, the alarm collection system of the local office has been enhanced as follows. FIG. 1B is a block diagram showing the system construction of an enhanced local office.

The STCNS 916 of the local office is substituted with an alarm shelf (ALMSH-B) 1016. Although the ALMSH-B 1016 collects alarms of the local office in the same manner as the STCNS 916 does, they differ in physical construction. The ALMSH-B 1016 is of a shelf type where many printed circuit boards can be inserted. In this construction, the number of printed circuit boards can be increased according to an increase of the number of alarm points. Thus, the number of alarm points can be increased from around 64 (in the STCNS 916) to around 1000 or more (in the ALMSH-B 1016). The ALMSH-B 1016 forms an alarm link with the CMOC 940 through the CSEI 919, the NW 913, the DT 921, and the TS 950. The ALMSH-B 1016 is connected to an alarm indicator panel unit (ALIPU) 1018.

In the conventional system, the MPR 914 which performs such processes as call-controlling and recognizing software alarms is connected to the VDU 915 which displays alarm messages and inputs commands. However, in the enhanced system, the VDU 915 is substituted with a system control workstation (SCWS) 1015. Thus, the man-machine interface for input and output operations is improved.

The MPR 914 is connected to the ALMSH-B 1016 through a packet link controller PLC 1017. The PLC 1017 communicates with the ALMSH-B 1016 according to a communication protocol named LAPB. The MPR 914 forms a No. 7 link 1065 through the CSE 922.

As described above, although improvements of the local office side have been proposed, there are some problems on the CMOC side.

(1) The consoles of the conventional MSTCNS 942 and SSCNS 943 cannot flexibly handle an increase of the number of local offices which collect alarms.

(2) In the conventional system, the man-machine interface is accomplished by the displays and dedicated input key sets of the consoles of the MSTCNS 942 and SSCNS 943. Thus, the man-machine interface is not satisfactorily flexible.

(3) The enhanced local office 1010 (hereinafter referred to as the enhanced office) and the conventional local office 910 (hereinafter referred to as the conventional office) coexist. However, the conventional CMOC cannot equally collect alarms from both the enhanced office and the conventional local office.

(4) Particularly, a moving telephone system such as a car telephone system or a portable telephone system whose usage has rapidly increased divides a pre-determined region up into smaller regions and provides a radio base office at most of the smaller regions, thereby performing a confirmation of the position of the moving telephone and relaying communications to the moving telephone. In such a radio base office, an abnormal temperature, a fire or a water leak may occur in a relay in the radio base office and it is necessary to supervise and manage the behavior of systems by incorporating the radio base office into the alarm system as one of the local stations.

SUMMARY OF THE INVENTION

An object of the present invention is to provide a central maintenance operation center which can flexibly handle an increase of the number of local offices under the control thereof, and equally collect alarms from an enhanced office and a conventional office, and provide a satisfactory man-machine interface.

Another object of the present invention is to provide an alarm collection apparatus for collecting an alarm from a radio base office provided for a moving communication.

A feature of the present invention resides in an alarm collection apparatus of a central maintenance operation center for use in an exchange system. The exchange system comprises a plurality of local offices, a central maintenance operation center, a toll switch, and an alarm link. The local offices include an enhanced local office and a conventional local office, the enhanced local office having enhanced features with respect to the number of alarm collection points, a display function thereof, and a man-machine interface. The enhanced local office and the conventional local office are connected to the central maintenance operation center through the toll switch, the toll switch being a switch office. Alarms collected from the enhanced local office and the conventional local office are sent through the alarm link, an alarm collection shelf for collecting alarm information from the enhanced local office and the conventional local office, and an MPU/workstation for performing an initial setting of the alarm collection shelf and editing/displaying collected alarm information.

Another feature of the present invention resides in an alarm collection apparatus provided with an alarm collection shelf for collecting an alarm from a radio base office.

BRIEF DESCRIPTION DRAWINGS

FIG. 13A is an example of a data format of a polling order PLODO;

FIG. 13B is an example of a data format of a status request order STRQO;

FIG. 14 shows an example of a data format of alarm answer data ALMDA from an enhanced office;

FIG. 15 shows an example of a data format of alarm answer data ALMDA from a conventional office;

FIG. 16 shows an example of a data format of status answer data STSDA from the conventional office;

Figure 27:
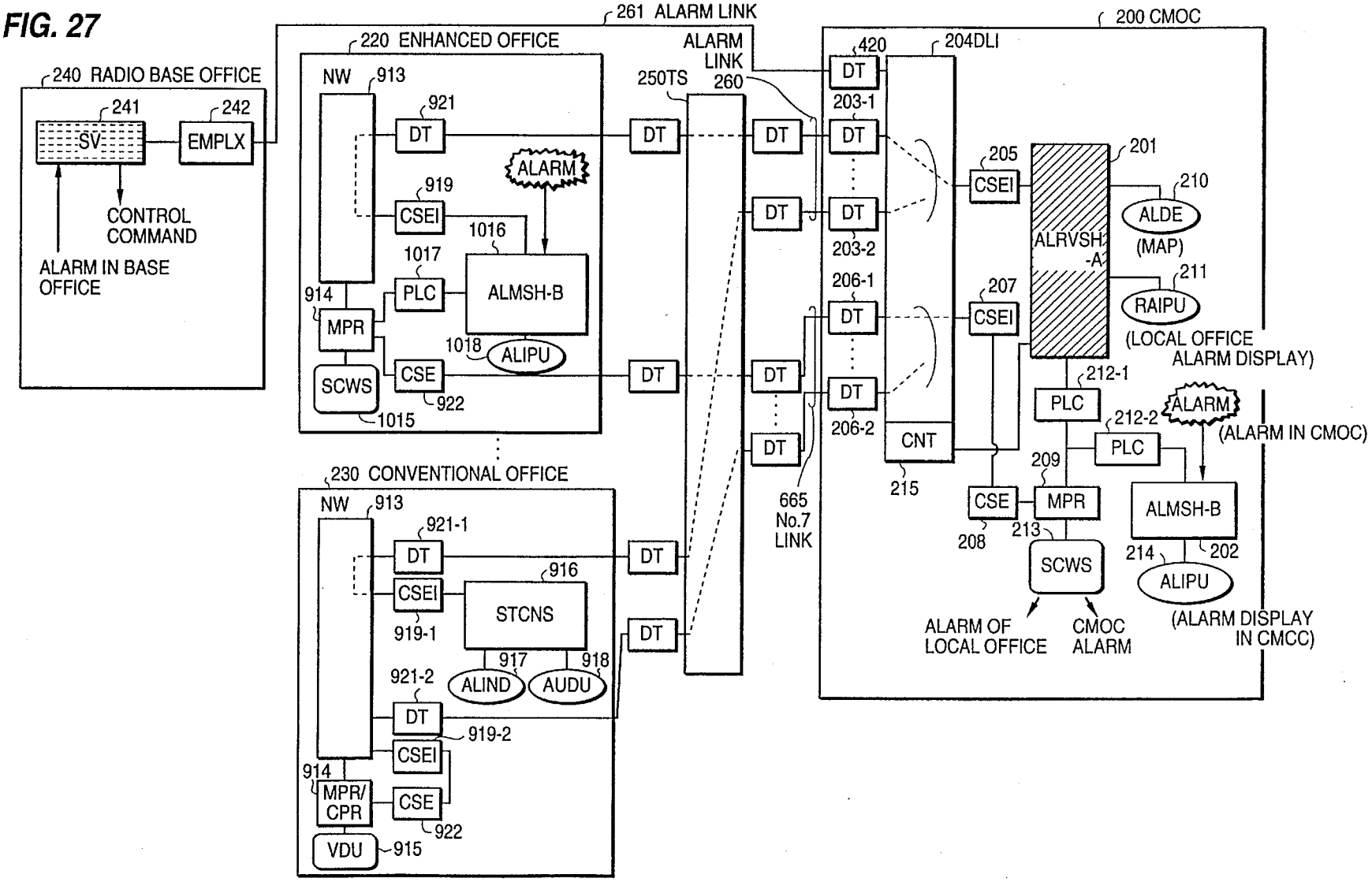
Figure 28:
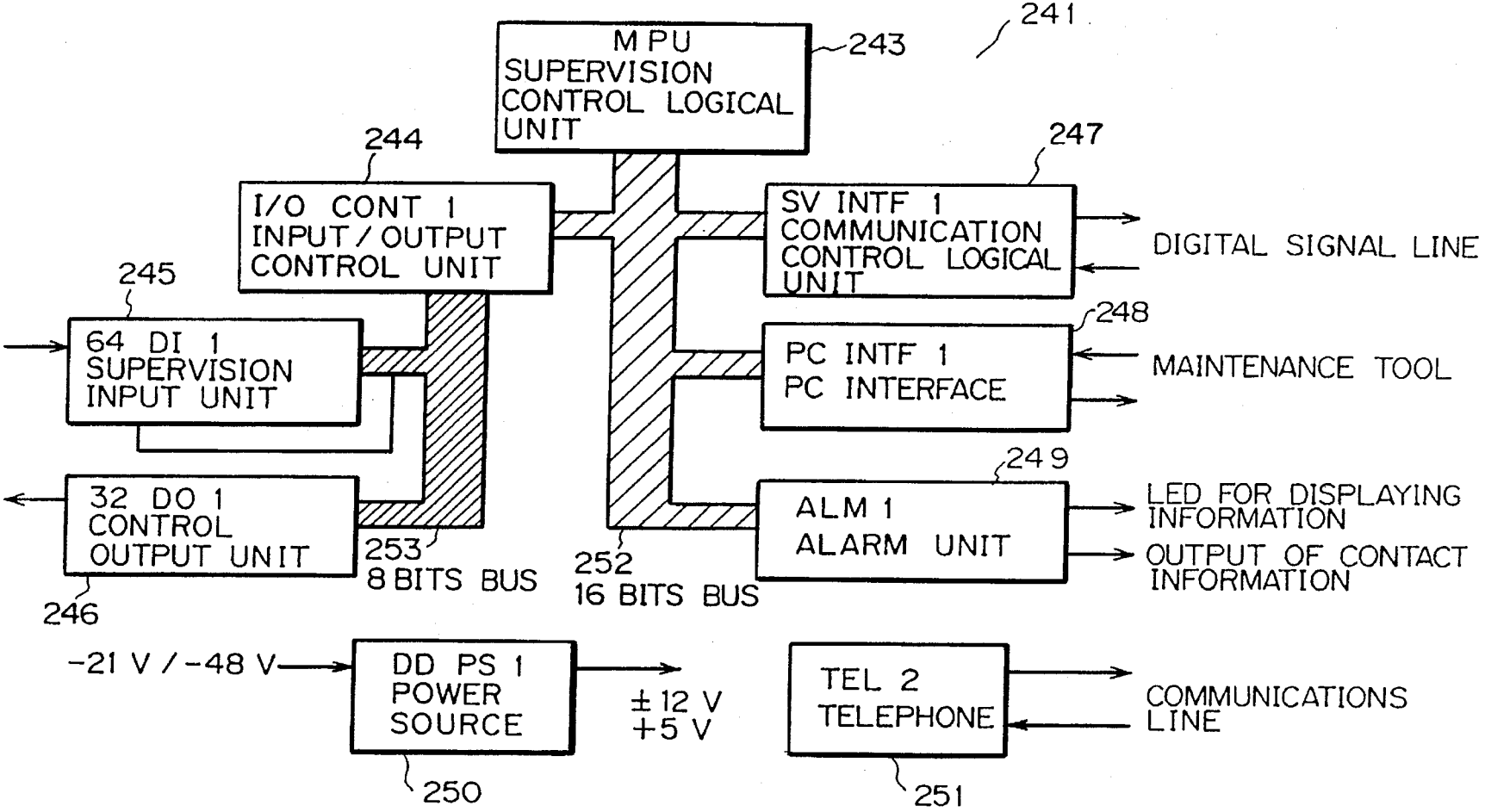
Figure 29:
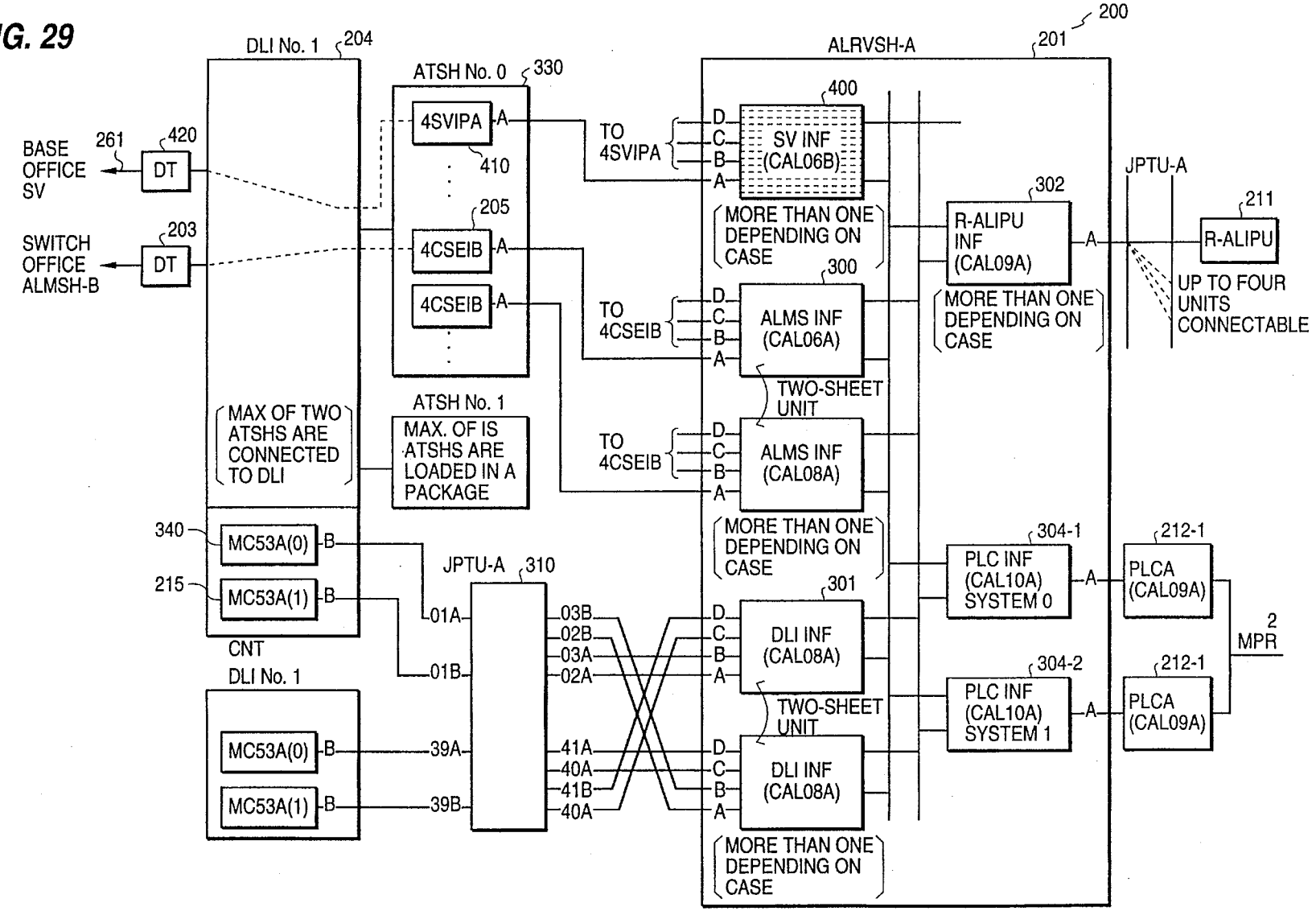
Figure 30:
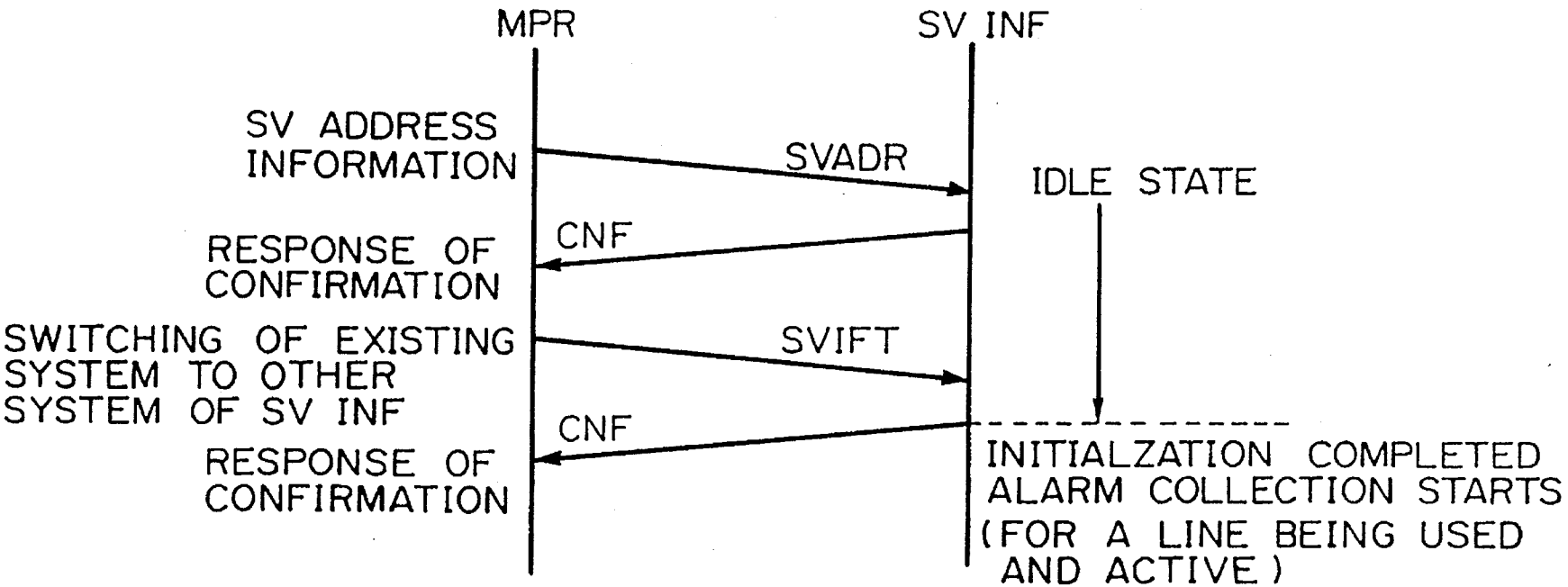
Figure 31:
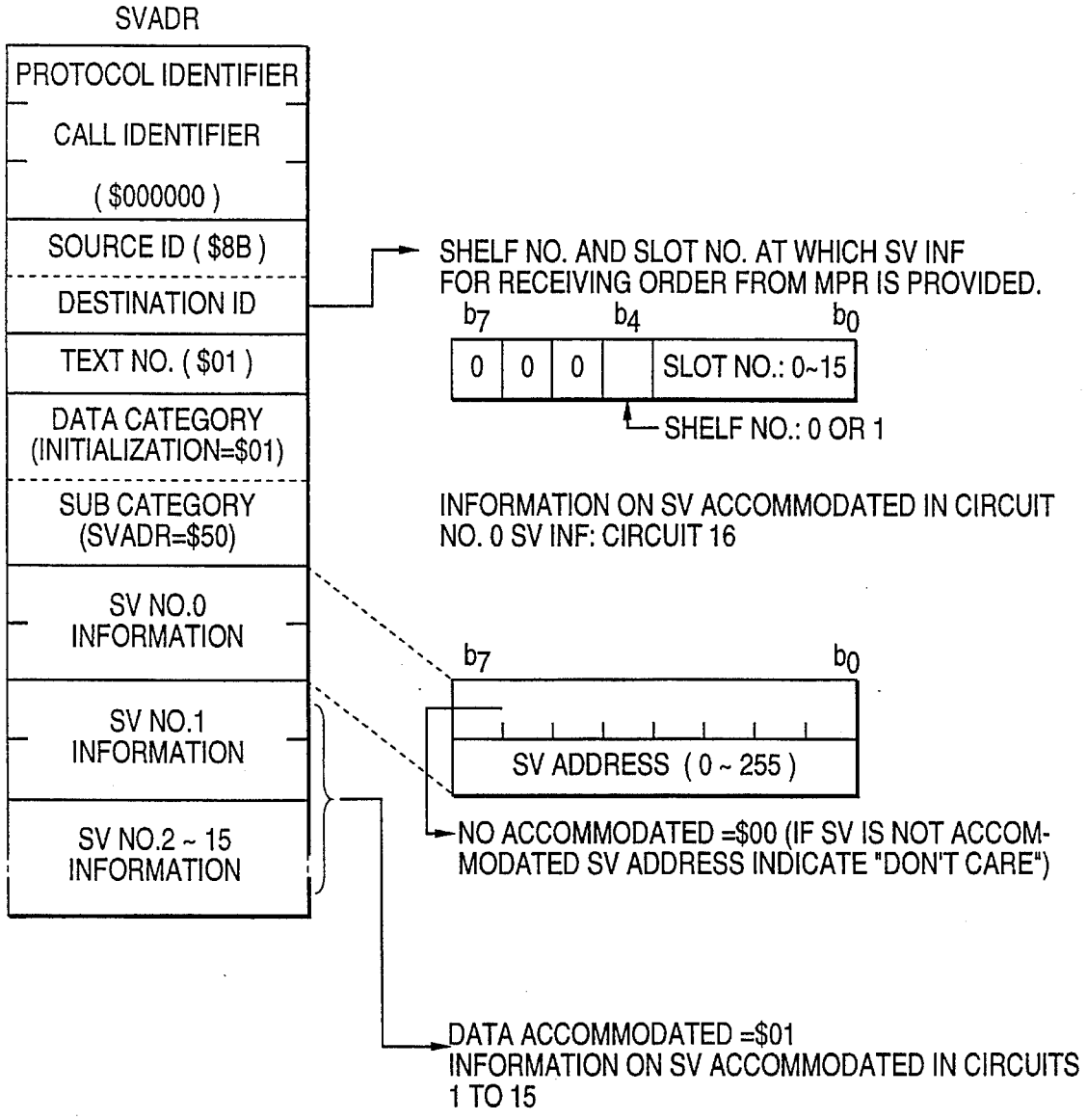
Figure 32:
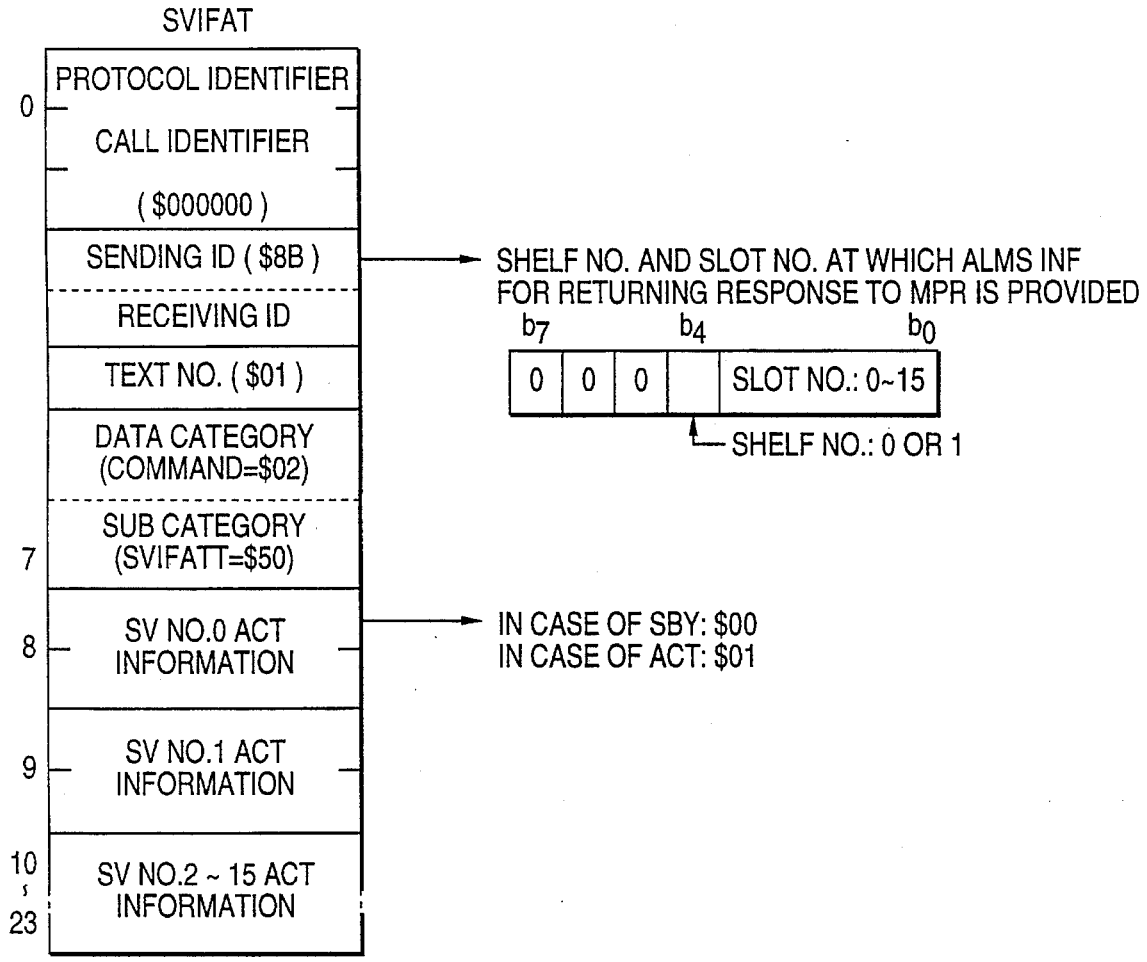
Figure 33:
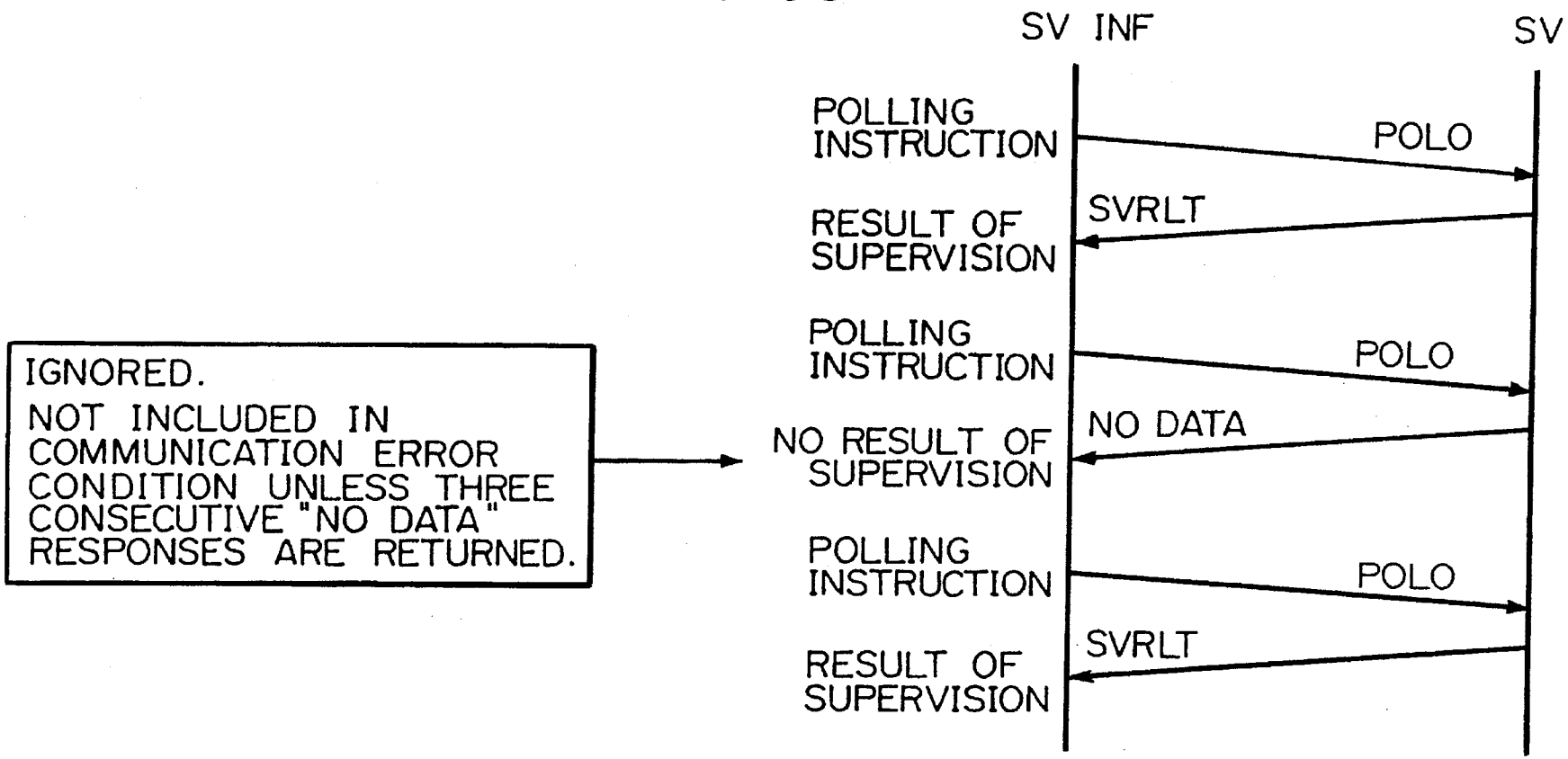

FIGS. 23 through 26 respectively show the data format of the alarm information LCALMPRD (I) to (IV) sent back to the main processor MPR;

FIG. 27 shows a block diagram of a second embodiment of that alarm collection apparatus according to the present invention;

FIG. 28 shows a structure of an SV in a radio base office;

FIG. 29 shows a block diagram of the alarm receiver shelf ALRVSH-A used in the second embodiment of the invention;

FIG. 30 shows a timing chart for a supervision process conducted in accordance with the second embodiment;

FIG. 31 shows an example of a data format of SVADR;

FIG. 32 shows an example of a data format of SVIFAT;

FIG. 33 is a timing chart of the alarm polling process according to the second embodiment of the present invention;

FIGS. 34A to 34B show an example of a data format of POLO;

FIGS. 35A to 35C show an example of a data format of the SVRLD; and

FIG. 36 shows an example of the items stored in the SVRLT.

One of skilled in the art can easily understand additional features and objects of this invention from the description of the preferred embodiments and some of the attached drawings.

DETAILED DESCRIPTION OF THE PREFERRED EMBODIMENTS

Figure 2:
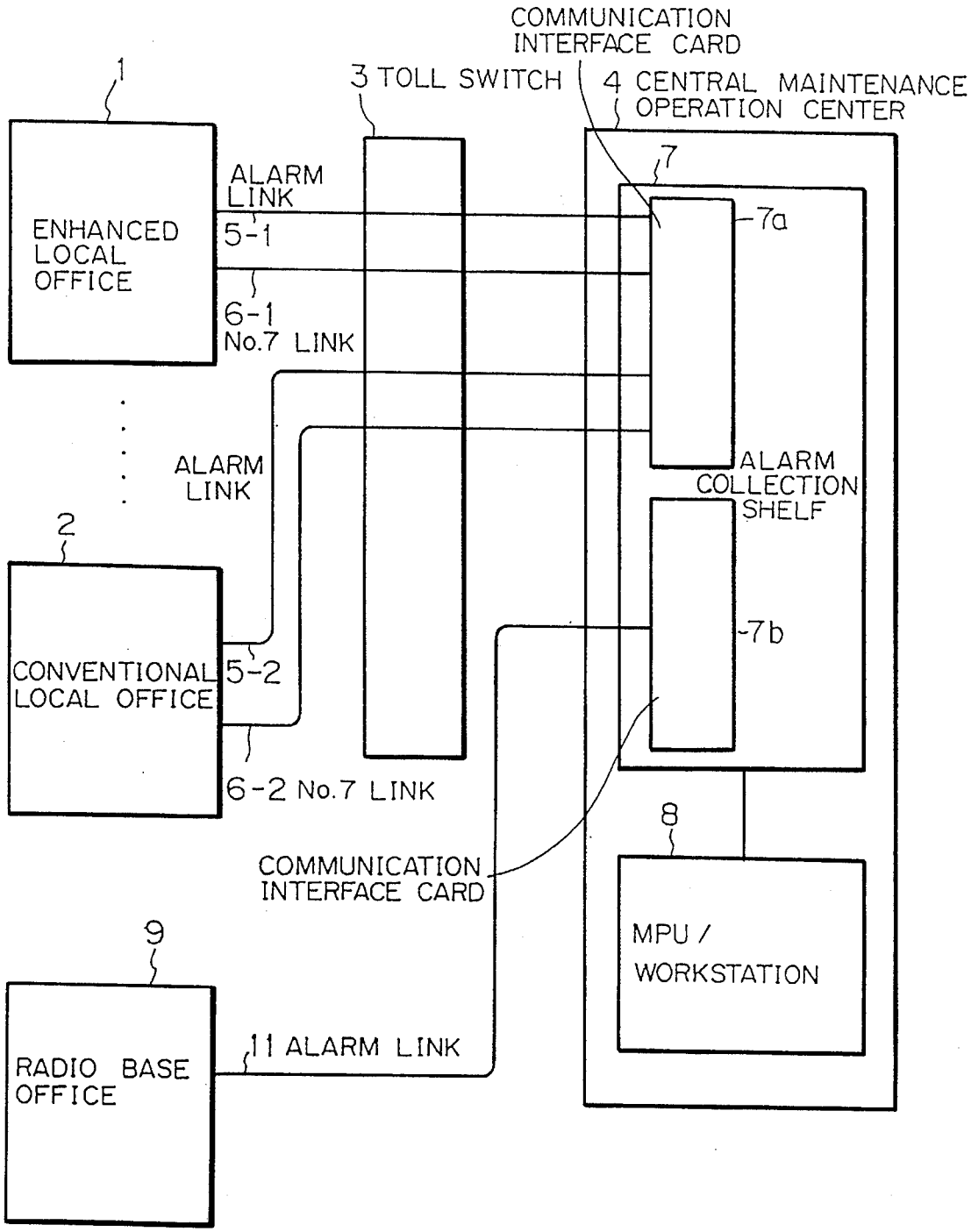
FIG. 2 is a block diagram illustrating the principle of the present invention.

FIG. 2 shows a principle of the present invention.

The present invention provides an alarm collection apparatus in a central maintenance operation center 4 for use in an exchange system. The exchange system includes a plurality of local offices, a central maintenance operation center 4, a toll switch 3, and an alarm link 5. The local offices include an enhanced local office 1 and a conventional local office 2. The enhanced local office 1 has enhanced features with respect to the number of alarm collection points, a display function thereof, and a man-machine interface. The enhanced local office 1 and the conventional local office 2 are connected to the central maintenance operation center 4 through the toll switch 3, the toll switch 3 being a switch office. Alarms collected from the enhanced local office 1 and the conventional local office 2 are sent through the alarm link 5. The alarm collection apparatus includes an alarm collection shelf 7 for collecting alarm information from the enhanced local office 1 and the conventional local office 2, and an MPU/workstation 8 for performing an initial setting of the alarm collection shelf 7 and editing/displaying collected alarm information.

In the alarm collection apparatus of the present invention, the alarm collection shelf 7 is of a shelf construction type where many printed circuit boards are inserted to accommodate a large number of local offices according to an increase in a number of interface cards for communicating with the enhanced local office 1 and the conventional local office 2.

The alarm collection shelf 7 is adapted to absorb differences in types and formats of information received from the enhanced local office 1 and the conventional local office 2 with respect to alarm information and system status information of local offices received from the alarm link 5. The alarm collection shelf 7 is also adapted to convert the format of the information received from the conventional local office 2 into the format of the information received from the enhanced local office 1, so as to control a plurality of local offices including the enhanced office 1 and the conventional local office 2.

The MPU/workstation 8 is adapted to perform the initial setting process and alarm information edit/display process through a flexible man-machine interface.

Further, the alarm collection shelf 7 also collects an alarm occurring in a radio base office 9, and alarm information is obtained from the radio base office 9 through an alarm link 11. The alarm collection shelf 7 comprises a shelf structure for accommodating a plurality of printed circuit boards inserted into the shelf structure. By increasing the number of a communication interface cards interfacing with the radio base office 9 by inserting communication interfaces into the shelf 7, many radio base offices are provided for and thus the system can deal with an increased number of radio base stations in a flexible manner.

MPU/workstation 8 is provided in the central maintenance operation center 4. The MPU/workstation 8 performs an initial setting of the alarm collection shelf 7 and editing and display of the collected alarm information through a flexible man-machine interface.

The central maintenance operation center 4 registers local offices to be controlled. This process is performed through the man-machine interface of the MPU/workstation 8. In other words, the central maintenance operation center 4 registers a position of the alarm collection shelf 7 to place a communication interface card 7*a* for communicating with each local office to be controlled and whether or not each local office is an enhanced office. The central maintenance operation center 4 also registers the place at which the communication interface card 7*b* for communicating with the radio base office 9 should be provided in the alarm collection shelf 7, and the distinction between the enhanced office and the conventional office.

After the initial registration is conducted, the alarm collection shelf 7 sequentially collects the alarm information from all the local offices 1, 2, 9 under its management. Where the alarm information is collected from the conventional local office 2, the format of the information from the conventional local office 2 is converted to the same format as that from the enhanced local office 1.

After performing the initial registration, the alarm collection shelf 7 collects alarm information from the local offices (1 and 2) through the alarm link 5 and the No. 7 link 6. When the collected alarm information is received from the conventional local office 2, the alarm collection shelf 7 converts the format of the information into that of the enhanced local office 1.

The alarm collection shelf 7 collects alarm information and converts it into a unified format. The MPU/workstation 8 performs processes such as editing and displaying the information received from the alarm collection shelf 7.

According to the present invention, with the ALMS INF, the number of local offices can be flexibly increased. With software on the MPR, information can be displayed on the SCWS workstation. Thus, an enhanced man-machine interface can be accomplished. The ALMS INF can equally handle both the conventional office 2 and enhanced office 1 and interface therebetween so as to absorb their differences.

Figure 3:
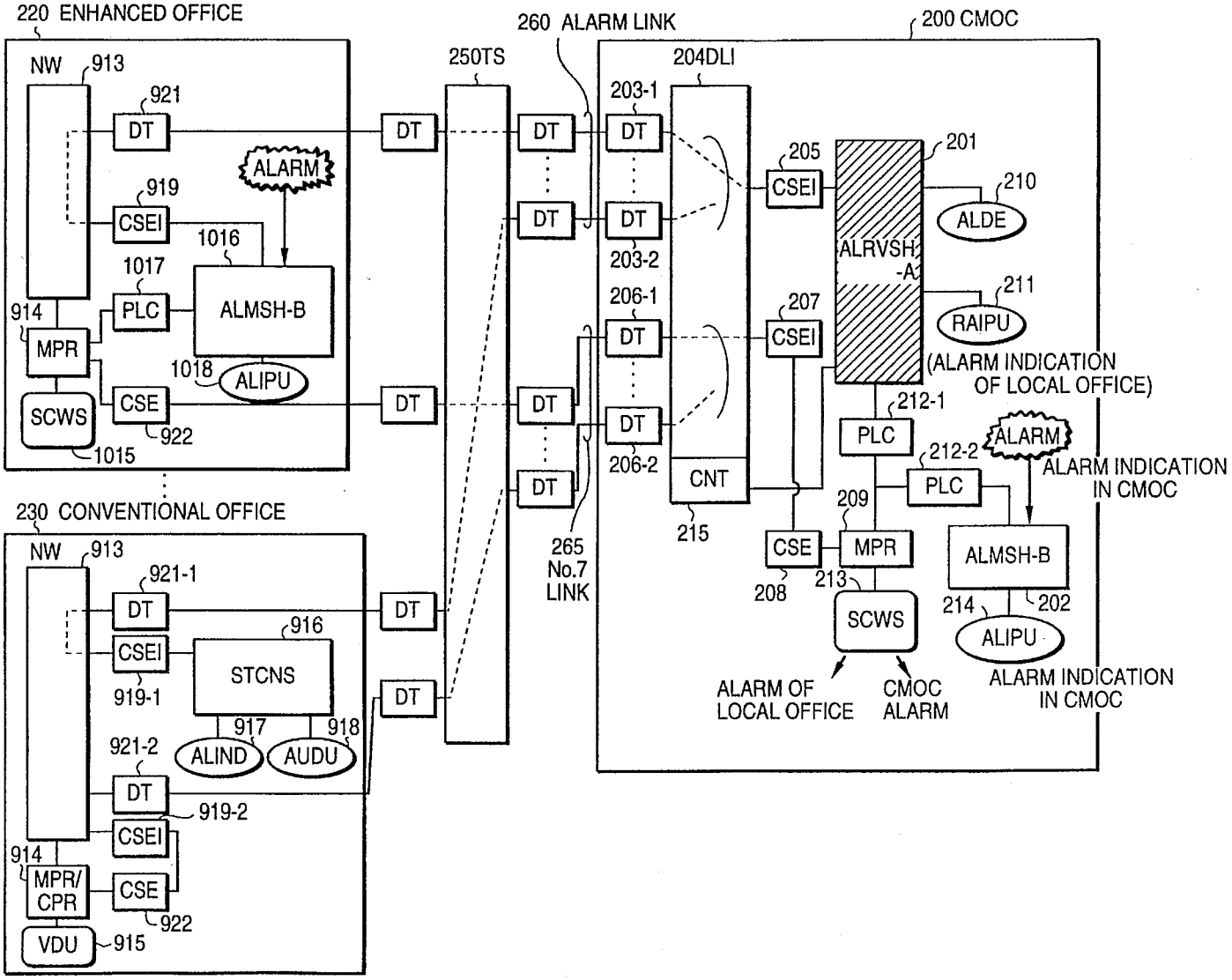
FIG. 3 is a block diagram of the alarm collection apparatus according to the present invention.

FIG. 3 is a block diagram showing the system construction of a preferred embodiment of the present invention. This system comprises a central maintenance operation center (CMOC) 200 and a plurality of local offices. The CMOC 200 collects alarms from the local offices under its control. The local offices can be categorized as an enhanced office 220 and a conventional office 230. The enhanced office 220 has enhanced functions with respect to man machine interface and alarm point extension. The CMOC 200 controls both the enhanced office 220 and the conventional office 230. The local offices (220 and 230) and the CMOC 200 are connected via a toll switch (TS) 250. The TS 250 is a switch office.

Figure 1A:
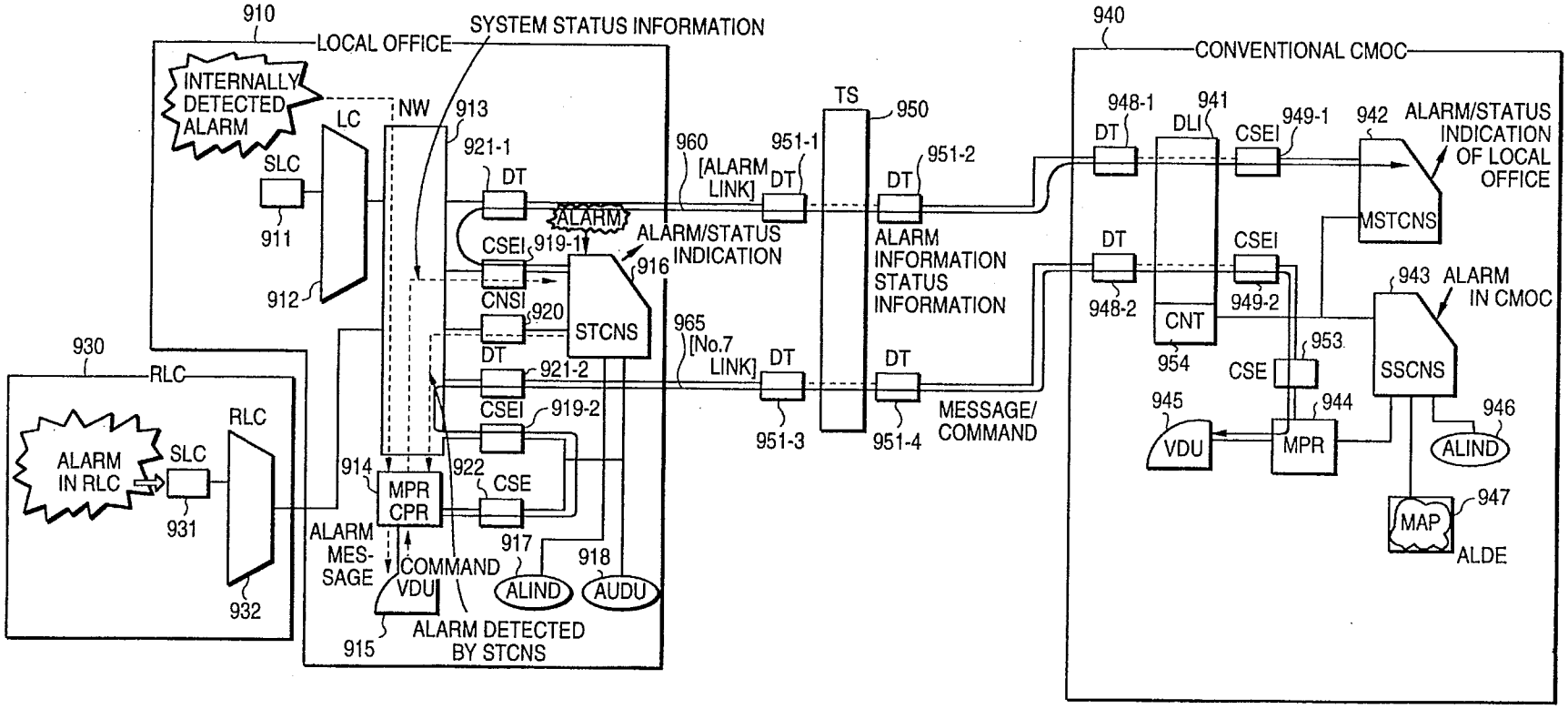
FIG. 1A shows a block diagram of a conventional alarm collection apparatus.
Figure 1B:
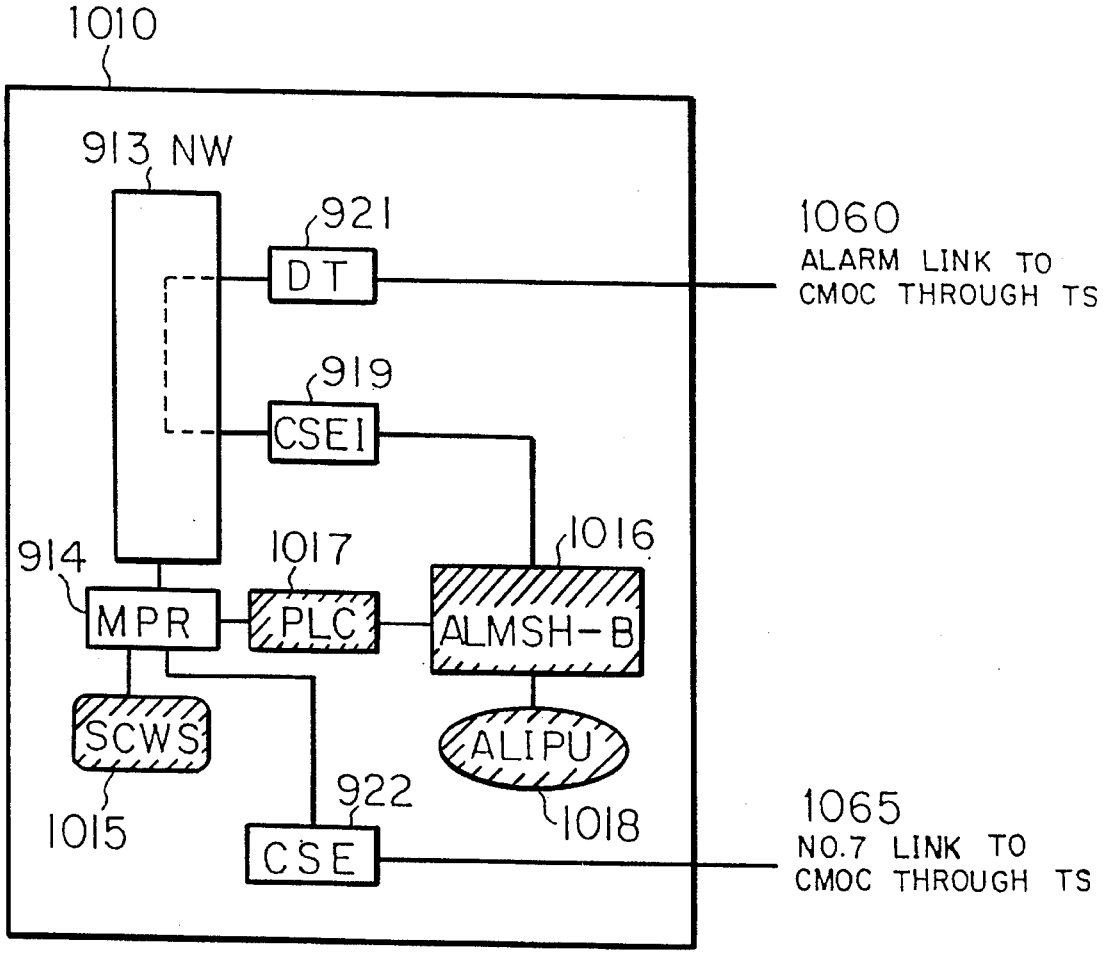
FIG. 1B is a block diagram showing a system construction of an enhanced local office.

The system construction of the conventional office 230 is the same as the internal construction of the local office shown in FIG. 1A. (For simplicity, in FIG. 3, portions which are the same as those in FIG. 1A are denoted by the same reference numerals.) The system construction of the enhanced office 220 is the same as that of the enhanced local office shown in FIG. 1B. (For simplicity, in FIG. 3, portions which are the same as those in FIG. 1B are denoted by the same reference numerals.) In addition, portions of the conventional office 230 which have the same functions as those of the enhanced office 220 are denoted by the same reference numerals.

In the CMOC 200, the master system test console (MSTCNS) of the conventional system is substituted with an alarm receiver shelf-A (ALRVSH-A) 201. In addition, the system supervisory console (SSCNS) is substituted with an alarm shelf-B (ALMSH-B) 202. The ALRVSH-A 201 collects alarms from all the local offices under the control thereof. On the other hand, the ALMSH-B 202 collects alarms from the CMOC 200. The ALMSH-B 202 has functions similar to those of the alarm collection shelf ALMSH-B 1016 of the enhanced local office 220.

The local offices (220 and 230) and the CMOC 200 are connected via an alarm link 260. The alarm link 260 is connected to the ALRVSH-A 201 of the CMOC 200 through a digital terminal (DT) 203, a digital line interface (DLI) 204, and a common channel signaling equipment interface (CSEI) 205. The DLI 204 is a switching unit. The ALVSH-A 201 is connected to alarm display equipment (ALDE) 210 and a remote alarm indicator panel unit (RAIPU) 211. The ALDE 210 displays on a map the positions of the local offices under the control of the CMOC 200 and the alarm statuses thereof. The RAIPU 211 displays alarms which occur in the local offices under the control of the CMOC 200.

In addition, the local offices (220 and 230) and the CMOC 200 are connected via a No. 7 link 265. The No. 7 link 265 is connected to a main processor (MPR) 209 of the CMOC 200 through a digital terminal (DT) 206, the DLI 204, a common channel signaling equipment interface (CSEI) 207, and common channel signaling equipment (CSE) 208.

Moreover, the MPR 209 is connected to the ALRVSH-A 201 through a packet link controller (PLC) 212-1 which in a communication interface unit according to the LAPB protocol. The MPR 209 is connected to a system control workstation SCWS 213 which performs an input/output process and an alarm message output process for controlling the entire system. Furthermore, the ALMSH-B 202 which collects alarms from the CMOC 200 is connected to the MPR 209 through a PLC 212-2. The ALMSH-B 202 is connected to the MPR 209 through the PLC 212-2. The ALMSH-B 202 is connected to an alarm indicator panel unit (ALIPU) 214 which displays alarms which occur in the CMOC 200.

Next, the basic operation of the alarm collection process will be described.

Before collecting alarms, initial setting software of the MPR 209 performs setting processes such as setting local offices to be accommodated, setting the interface of the ALRVSH 201, and setting the DLI 204. The setting processes are performed through a man-machine interface of the SCWS 213.

After executing the initial setting processes, the ALRVSH-A 201 starts collecting alarms from the local offices (220 and 230) under the control of the CMOC 200. The ALRVSH-A 201 independently and periodically collects the alarms through the alarm links and stores these data. At this point, the ALRVSH-A 201 collects alarm information from the enhanced office 220. In addition, the ALRVSH-A 201 collects status information as well as alarm information from the conventional office 230. The alarm and status information received from the enhanced office 220 has been edited thereby. On the other hand, since the conventional office 230 does not edit the alarm and status information, the ALRVSH-A 201 collects and edits this information.

The ALRVSH-A 201 displays the collected alarm/status information on the ALDE 210 and the RAIPU 211.

On the other hand, the MPR 209 periodically requests the ALRVSH-A 201 for alarm data stored therein independently from the ALRVSH-A 201 which collects alarms. The MPR 209 can analyze and edit the received alarm data and display the result on the SCWS 213.

Figure 4:
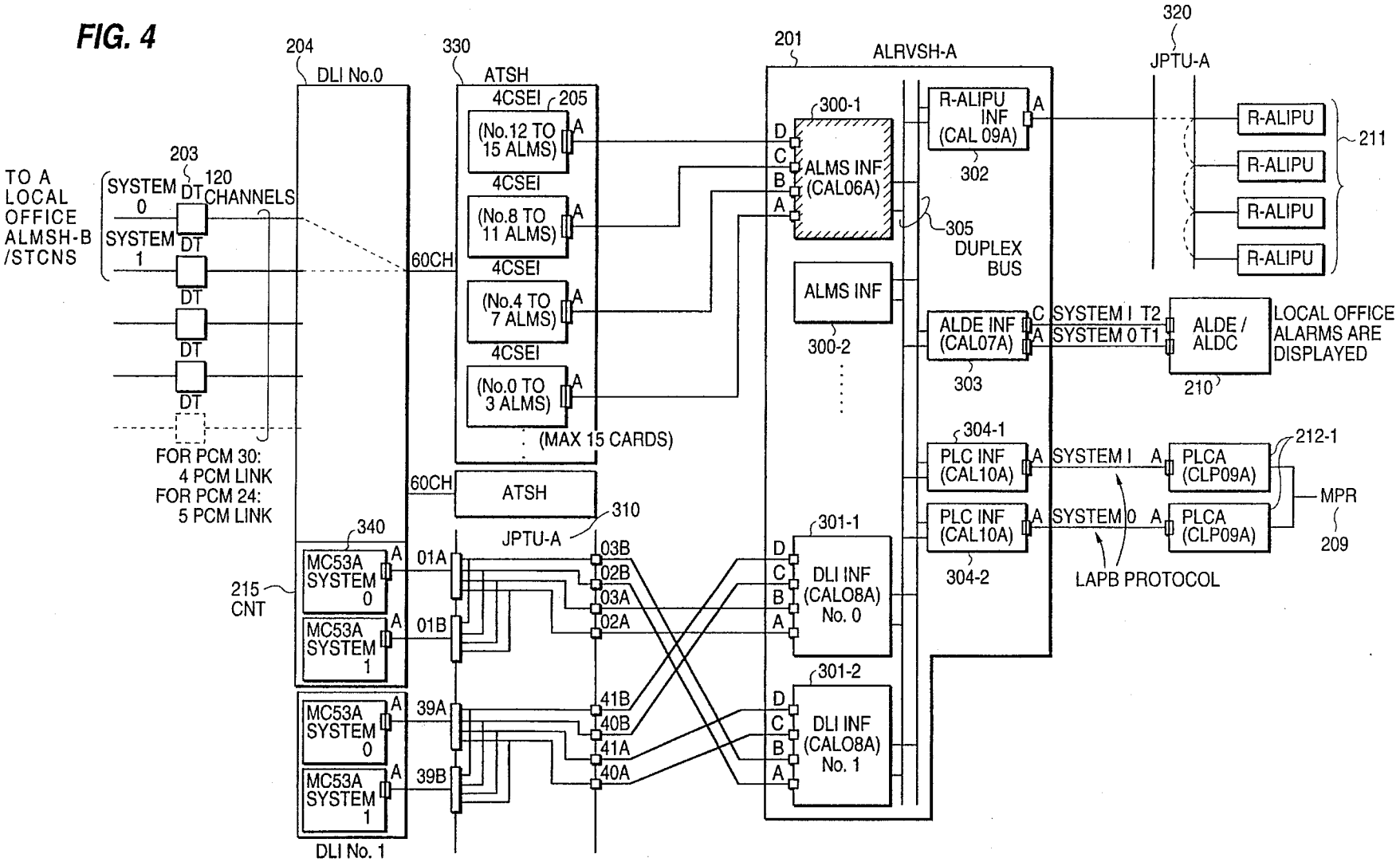
FIG. 4 is a schematic diagram of the hardware construction of alarm shelf ALRVSH-A.

FIG. 4 is a schematic diagram showing the system construction of hardware of the ALRVSH-A 201. The ALRVSH-A 201 is of a shelf type where functional packages (cards) are inserted into a shelf.

Figure 5A:
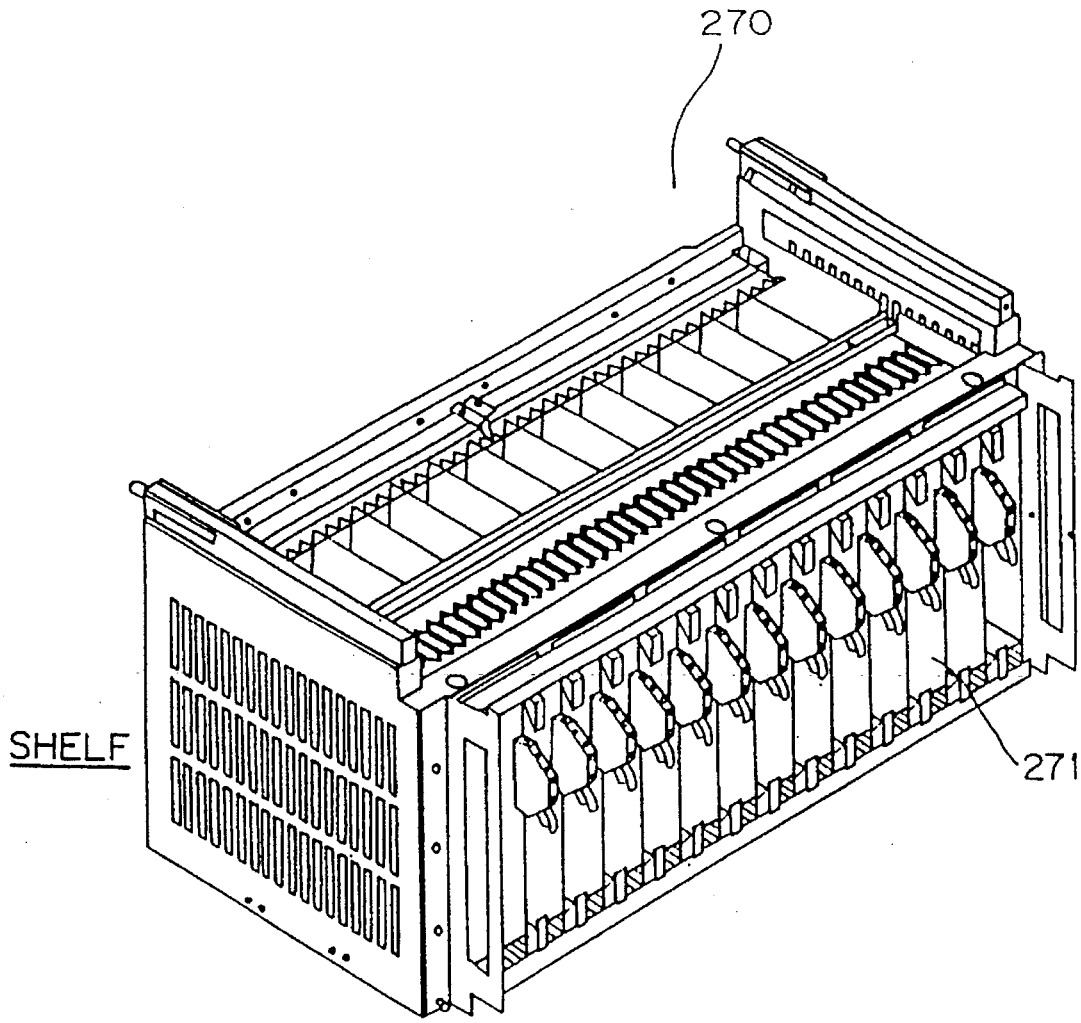
FIG. 5A shows a perspective view of the alarm shelf of FIG. 4.

FIG. 5A shows a perspective view of the shelf structure. Fifteen packages (cards) 271 can be inserted in a single shelf 270. The package 271 has various functions and, for example comprises ALMS INF 300 (FIG. 4) acting as an interface with CSEI 205 to perform communications with a local office, DLI INF 301-1 acting as an interface with the controller portion (CNT) 215 in the DLI 204 through JPTU-A 310, R-ALIPU INF 302 for transmitting alarm display information to the alarm indicator panel R-ALIPU 211 through JPTU-A 320, ALDE INF 303 for controlling the ALDE/ALDC 210 for displaying the alarm on the map, and the PLC INF 304 acting as an interface with the PLC 212-1 which exists between the MPR 209 and ALRVSH-A 201. In the package 271, the ALMS INF 300 manages sixteen local stations by using a single package 271 as will be described later. Thus, a plurality of ALMS INF's 300 are inserted in a single shelf 270 to perform maintenance and management of more than sixteen local stations.

That is, the ALMS INF 300 is connected to the CSEI 205 equipped with analog trunk shelf (ATSH) 330. A single ALMS INF 300 can be connected to four CSEI apparatus packages at maximum, namely, 16 CSEIs. Therefore a single ALMS INF 300 can include 16 local stations at maximum. Respective apparatuses within ALRVSH-A201 are connected to a duplex bus and a LAN communication is performed over the duplex bus. Thus, two DLI INF 301 cards for controlling the DLI 204 and two are PLC INF 304 cards connected to the processor MPR 209. When the package 271 is installed in the shelf 270 as shown in FIG. 5A, respective contacts at the edge of the package 271 are connected to the terminals of the shelf 270 which form the indirect connector on the rear surface.

Figure 5B:
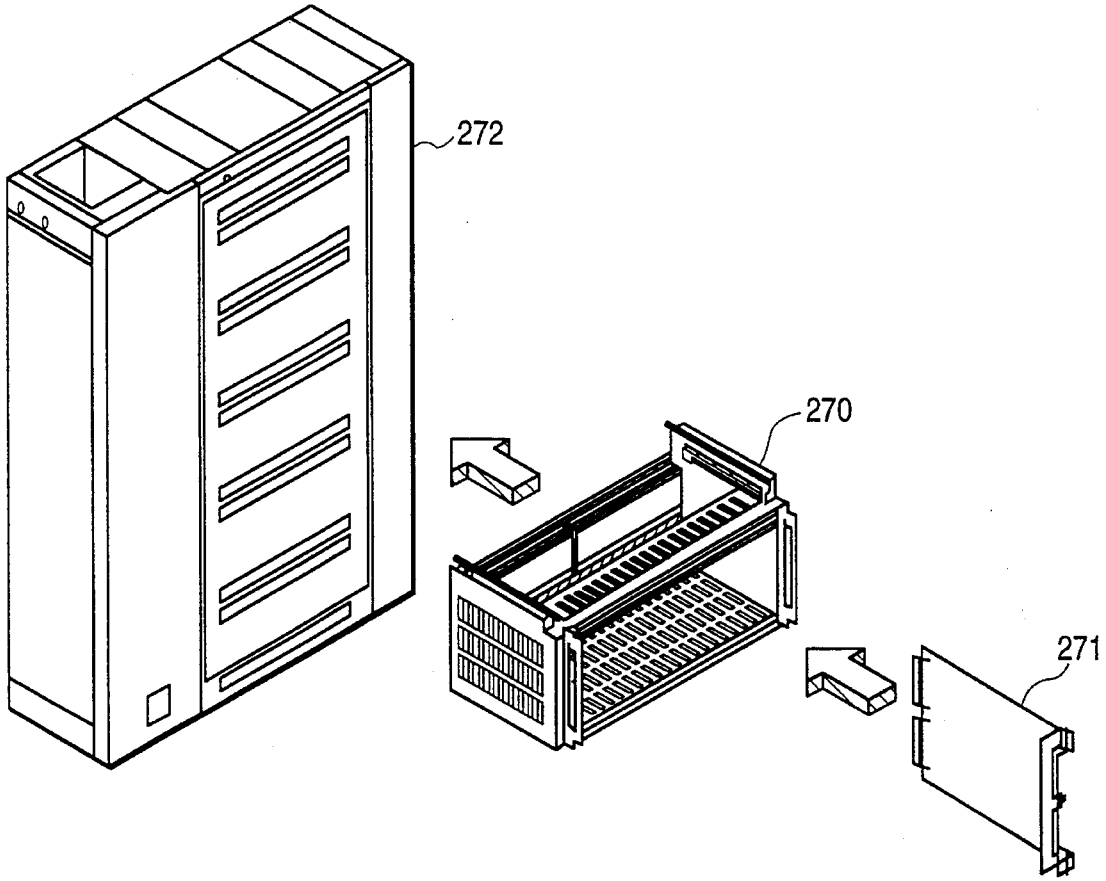
FIG. 5B shows assembly of the alarm shelf of FIG. 4.

The shelf 270 with the above structure can be installed in a cabinet 272 as one unit as shown in FIG. 5B. Thus, mainly ALM INFs 300 (packages 271) can be installed in the cabinet 272 and, as described above, a single ALMS INF 300 can cover 16 local stations. Accordingly, considering the entire unit, many local stations can be subject to maintenance and managed.

As examples of functional cards, there are an ALMS INF 300, a DLI INF 301-1, an R-ALIPU INF 302, an ALDE INF 303, and a PLC INF 304. The ALMS INF 300 interfaces with the CSEI 205 so as to communicate with a local office. The DLI INF 301-1 interfaces with a controller portion CNT 215 of the DLI 204 through a JPTU-A 310. The R-ALIPU INF 302 sends alarm indication information to an alarm indicator panel R-ALIPU 211 through the JPTU-A 320. The ALDE INF 303 controls the ALDE/ALDC 210 which displays alarms on a map. The PLC INF 304 interfaces with a PLC 212-1 disposed between the MPR 209 and the ALRVSH-A 201.

Each card inserted into the ALRVSH-A 201 is connected to a duplex bus. Thus, LAN communication is performed on the duplex bus.

The ALMS INF 300 is connected to the CSEI 205 inserted into an analog trunk shelf (ATSH) 330. The ATSH 330 can accommodate up to 15 cards, each of which can accommodate four CSEIs 205. One ALMS INF 300 can be connected to up to four cards (namely, 16 CSEIs 205). Thus, one ALMS INF 300-1 can accommodate up to 16 local offices. Realistically, another ALMS INF (for example, 300-2) accommodates the same local office as the ALMS INF 300-1 so as to duplex the system. The CSEI 205 forms a link to the local offices (220 and 230) with the switching unit DLI 204 and the DT 203. According to the related art reference, the DLI 204 switches the local offices so as to collect alarms therefrom. In contrast, according to the present invention, a fixed path is formed on an office-by-office basis and alarms therefrom are collected.

When the DLI INF 301 sets or changes a fixed path of the DLI 204 by using MPR 209 software, it sends relevant information to an MC53A 340 of the CNT 215 of the DLI 204. Since the DLI INF 301 is duplexed, two DLI INFs (301-1 and 301-2) communicate with up to two DLIs through system 0 and system 1, respectively.

The R-ALIPU INF 302 comprises a main processor MPU and a communication interface. The R-ALIPU INF 302 is connected to up to four R-ALIPUs 211 through the JPTU-A 320. The four R-ALIPUs 211 will be installed at different positions. The two or more R-ALIPU INFs 302 send the same alarm information so as to cause it to be displayed.

In addition, the PLC INF 304 is duplexed. In other words, two PLC INFs 304-2 and 304-1 of system 0 and system 1, respectively, are connected to a duplex bus 305. These PLC INFs 304-1 and 304-2 communicate with the MPR 209 through the respective PLCs 212-1 according to the LAPB protocol.

Figure 6:
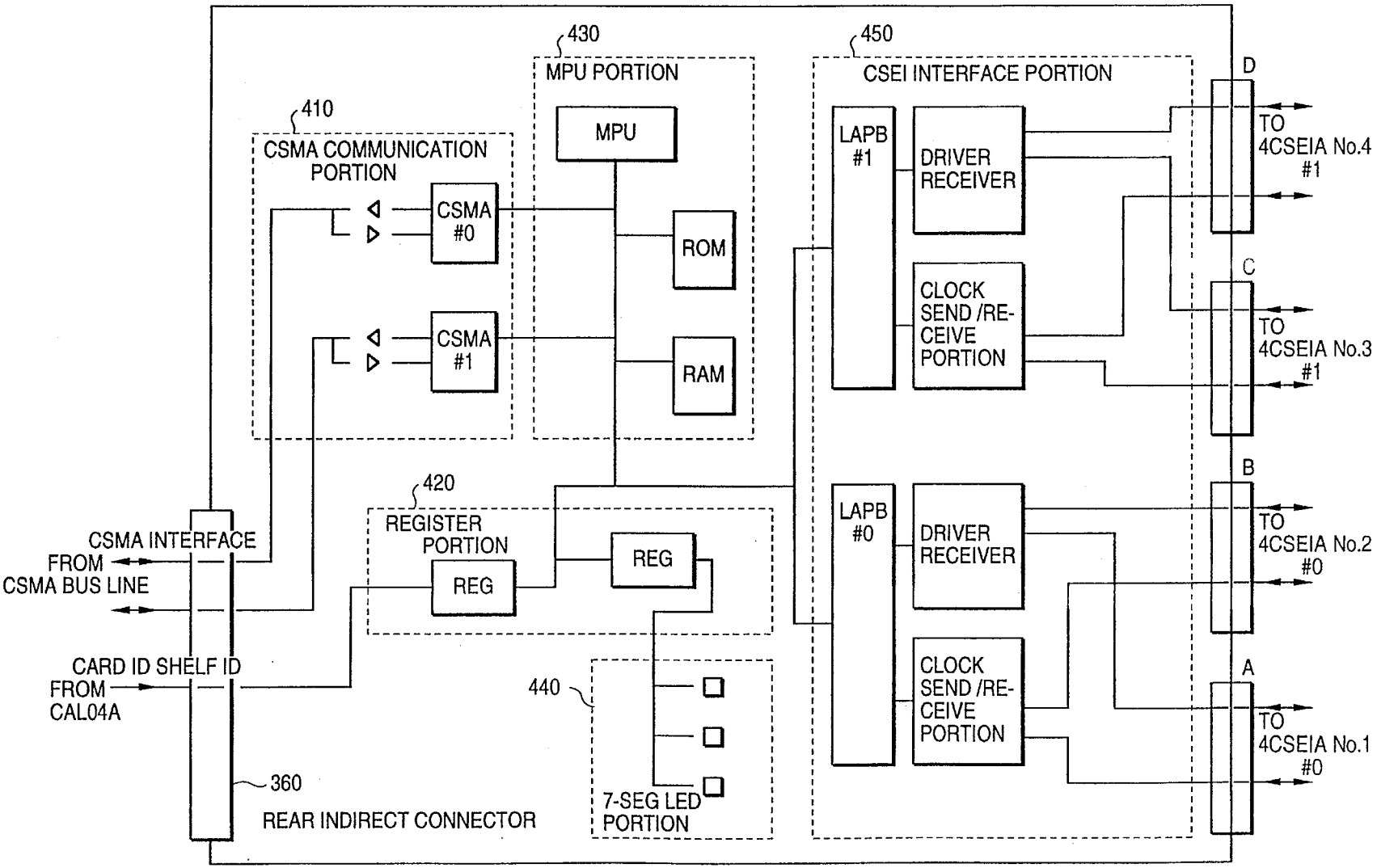
FIG. 6 is a schematic block diagram of the ALMS INF.

FIG. 6 is a block diagram of the ALMS INF 300 accommodated in the ALRVSH-A 201.

The ALMS INF 300 comprises five portions which are a CSMA communication portion 410, a CSEI interface portion 450, an MPU portion 430, a register portion 420, and a 7-SEGMENT LED portion 440. The CSMA communication portion 410 is connected to the duplex bus 305 of the ALRVSH-A 201 through a rear indirect connector 360. The CSMA communication portion 410 performs LAN communication. The CSEI interface portion 450 communicates with the local offices (220 and 230) through up to four 4-CSEI cards 205 in LAPB transparent mode. The MPU portion 430 controls communications and processes. The MPU portion 430, the register portion 420, and the CSEI interface is portion 450 are connected to each other through an internal bus.

The MPU portion 430 comprises a main processor MPU, a ROM, and a RAM. The ROM and RAM store software and data.

The CSMA communication portion 410 has two CSMA interfaces, namely system 0 (CSMA #0) and system 1 (CSMA #1) which are connected to the duplex bus 305. The CSMA communication portion 410 is connected to the duplex bus 305 through the rear indirect connector 360. In addition, the CSMA communication portion 410 is connected to the MPU portion 430.

The register portion 420 is constructed of a plurality of registers. The register portion 420 is connected to the rear indirect connector 360 so as to send and receive a shelf ID and a card ID which identify a card of a shelf of the ALRVSH-A 201 with which communication is to be performed. In addition, the register portion 420 is connected to the 7-SEGMENT LED portion 440.

The CSEI interface portion 450 comprises two sets of LAPB interfaces, drivers/receivers, and clock send/receive portions so as to construct a duplex system.

Figure 7:
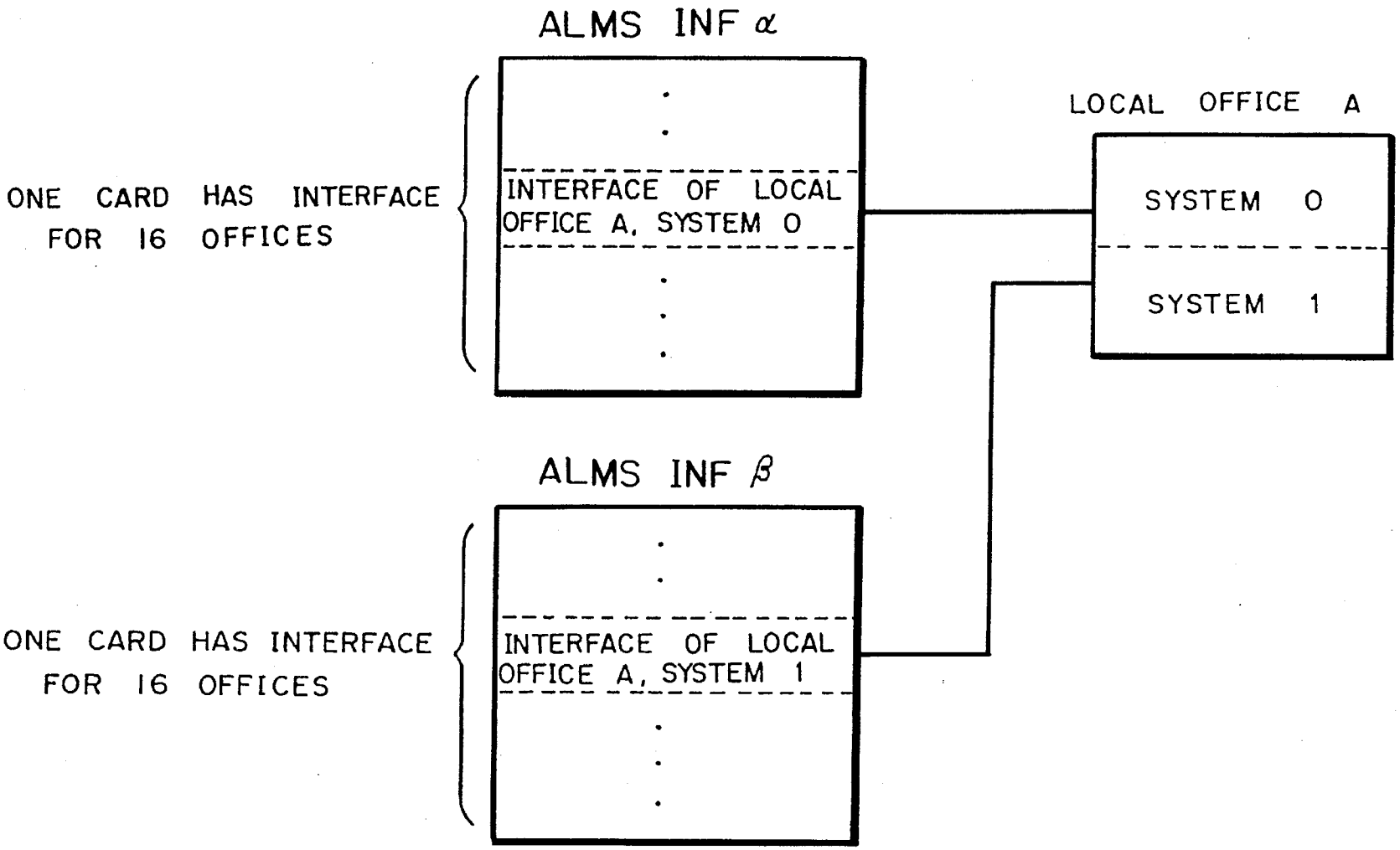
FIG. 7 is a block diagram of a duplex ALMS INF system.

FIG. 7 is a block diagram showing a duplex system of ALMS INF cards.

Each local office is duplexed with two systems, namely system 0 and system 1. Each system is connected to the relevant ALMS INF card 300 ($\alpha$ or $\beta$ in FIG. 7) to communicate therewith.

As shown in FIG. 6, the CSEI interface portion 450 is connected to four 4-CSEI cards 205 (that is, 16 local offices). The CSEI interface portion 450 is broken down into system 0 and system 1. The system 0 of the CSEI interface portion 450 is connected to two 4-CSEI cards of system 0 (namely, eight local offices of system 0). The system 1 of the CSEI interface portion 450 is connected to two 4-CSEI cards of system 1 (namely, eight local offices of system 1).

Next, the operation of an alarm collection process will be described.

Before collecting alarms, the software of the MPR 209 performs an initialize process such as setting the statuses of local offices accommodated in the ALMS INF 300. The MPR 209 performs a LAN communication with each card of the ALRVSH-A 201 through the PLC 212-1 and the PLC-INF 304 on a card-by-card basis. This communication is performed in such a way that the MPR 209 sends an order to a card with which communication is to be performed and this card sends a response back to the MPR 209.

Figure 8:
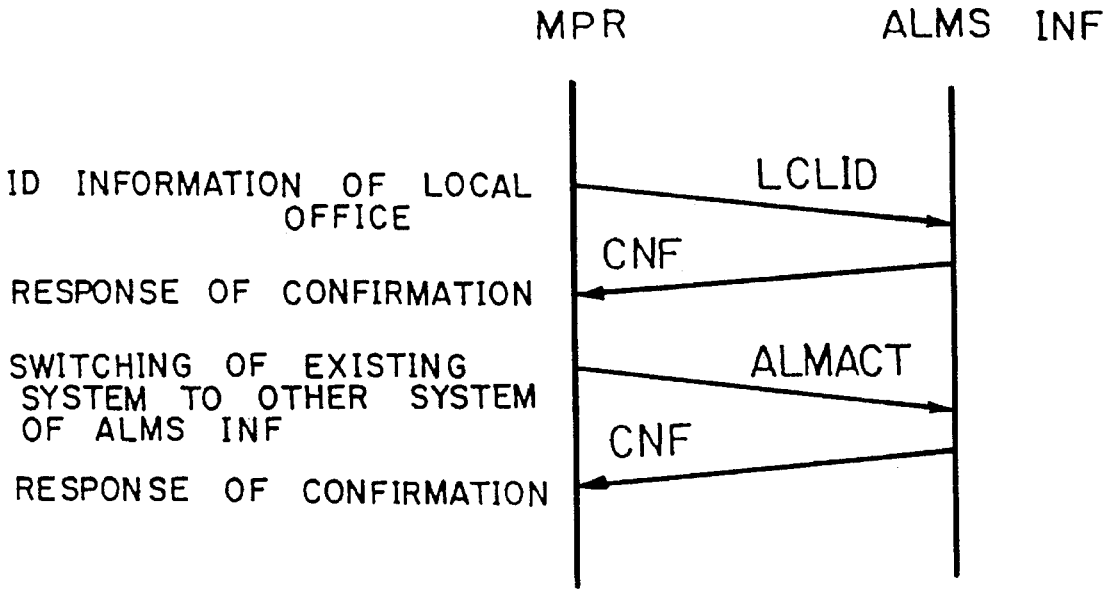
FIG. 8 is a timing chart of the ALMS INF initializing process.

The initialize process is performed when the MPR 209 is initialized or the power of the ALRVSH-A 201 is turned on. FIG. 8 is a time chart of the initialize process of the ALMS INF 300. The MPR 209 sends to each ALMS INF 300 inserted in the ALRVSH-A 201 an order LCLID which requests from a respective ALMS INF 300 a local office to be accommodated.

Figure 9:
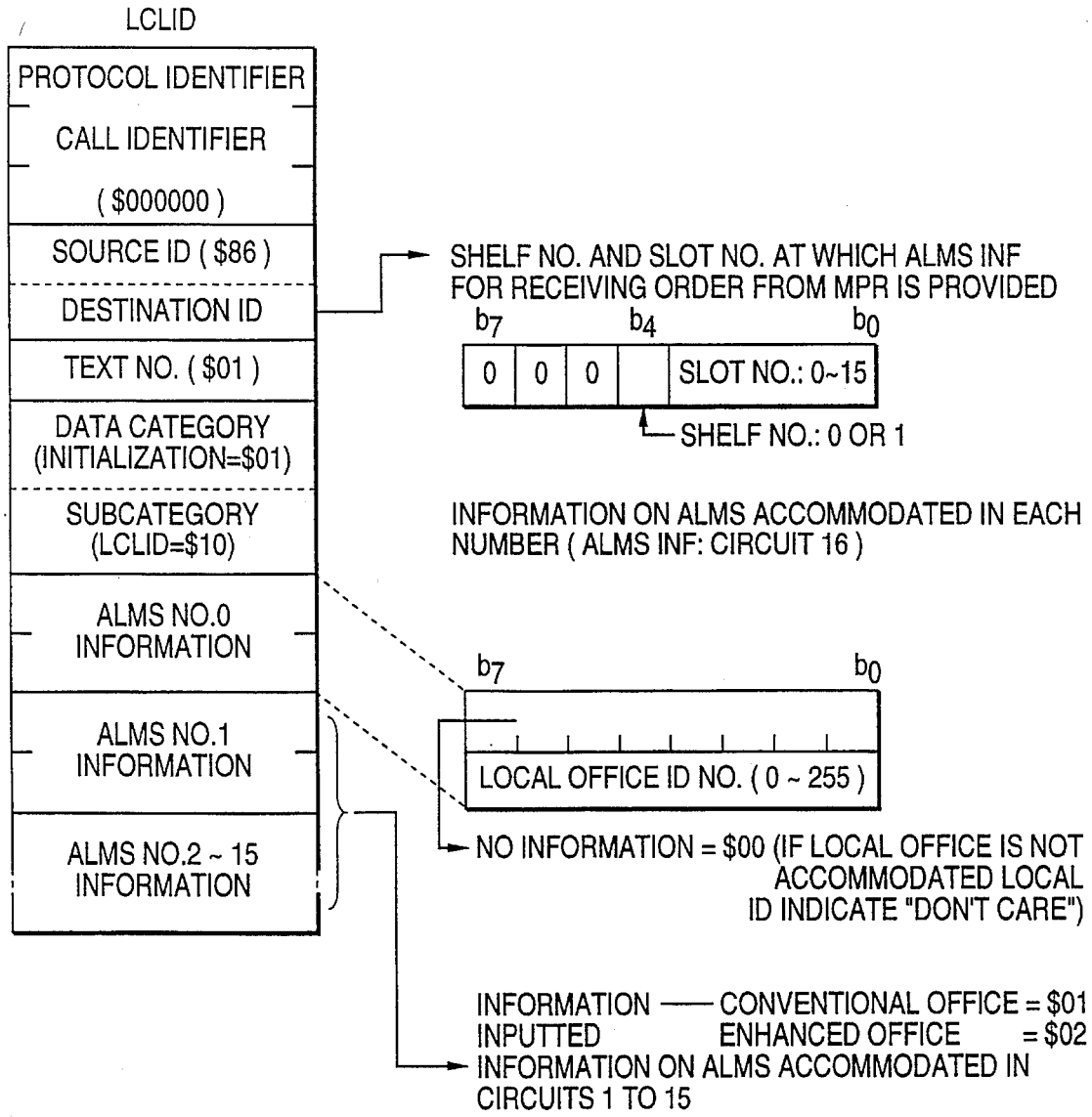
FIG. 9 is an example of a data format of an LCLID order.

FIG. 9 shows an example of a data format of the LCLID order. The LCLID order comprises 40 bytes and includes a protocol identifier, source ID, destination ID, text number, data category, subcategory and ALMS numbers 0–15. An identifier designating that the data format is an LCLID order is written as the protocol identifier, the ID number of the processor MPR 209 forming a source terminal is written as the source ID and is, for example "86". The shelf and slot number of the ALMS INF 300 corresponding to the destination terminal are written as the destination ID. Based on the address data written in the ALMS numbers 0–15, the number and the position of the local office which is covered by the ALMS INF 300 are determined. The position of each local office is determined based on the address data written in the each of ALMS numbers 0–15 and the number of local stations can be obtained based on the number of areas in the ALMS numbers 0–15 in which "00" (don't care) is written. By examining the pre-determined bit of the data written in ALMS numbers 0–15, it is determined whether the local office is an enhanced office 220 or a conventional office 230.

By outputting the above LCLID order to the ALRVSH-A201, the shelf and the slot position of the corresponding ALMS INF 300 is specified based on the destination ID and the name of the local office to be controlled by the INF 300 and the number of the local stations is determined and whether the local office is an enhanced office or not is also determined.

The data category included in the above LCLID order represents the kind of order and the subcategory represents the detailed information within the category. The text number shows the numbering of the responses to the LCLID order.

Figure 10:
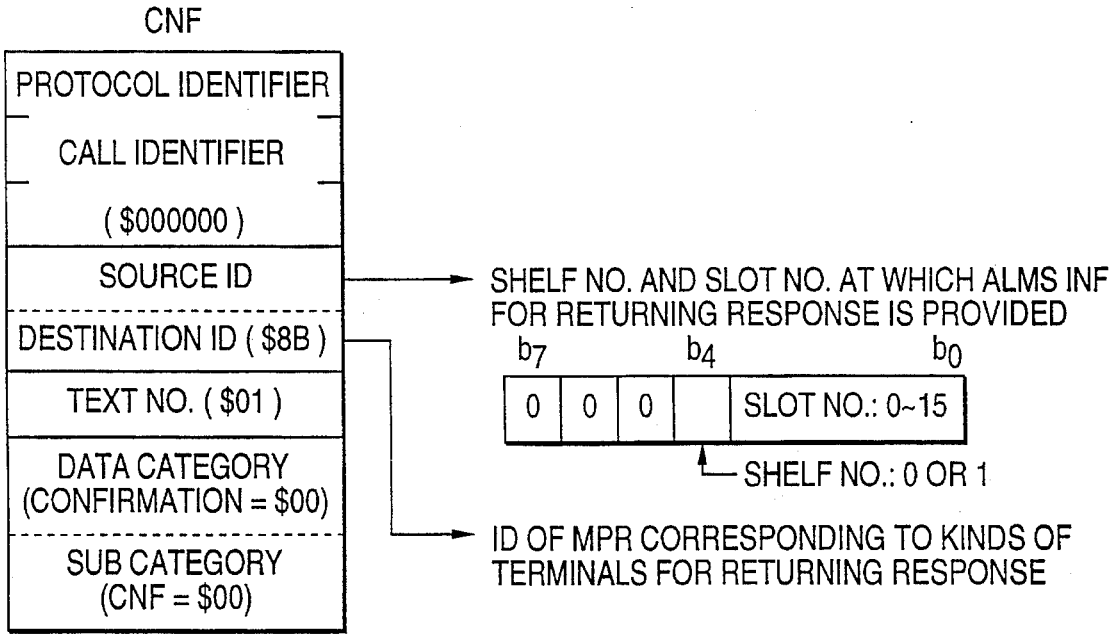
FIG. 10 is an example of a data format for a confirmation response CNF.

After the ALMS INF 300 receives the LCLID order, it sends a confirmation response CNF (FIG. 8) back to the MPR 209. FIG. 10 is an example of the data format for the confirmation response CNF. The confirmation response CNF comprises 8 bytes and also comprises a protocol identifier, source ID, destination ID, text number, data category and subcategory. An identifier indicating that the data is the confirmation response CNF is written or installed as the protocol identifier. The shelf number and slot number of the corresponding ALMS INF 300 are written as the source ID, and an ID code such as "88" for the processor MPR 200 is written or installed as the destination ID. Therefore, after the corresponding ALMS INF 300 receives the previously described LCLID order and confirms the position of the local office, the ALMS INF 300 outputs the confirmation response CNF to processor MPR 209 forming the destination terminal, and thus the processor MPR 209 determines that the order LCLID arrived at the ALMS INF 300 corresponding to the shelf number and slot number written in the CNF response. The confirmation response CNF is outputted under the control of the MPU portion 430 in the ALMS INF 300.

Figure 11:
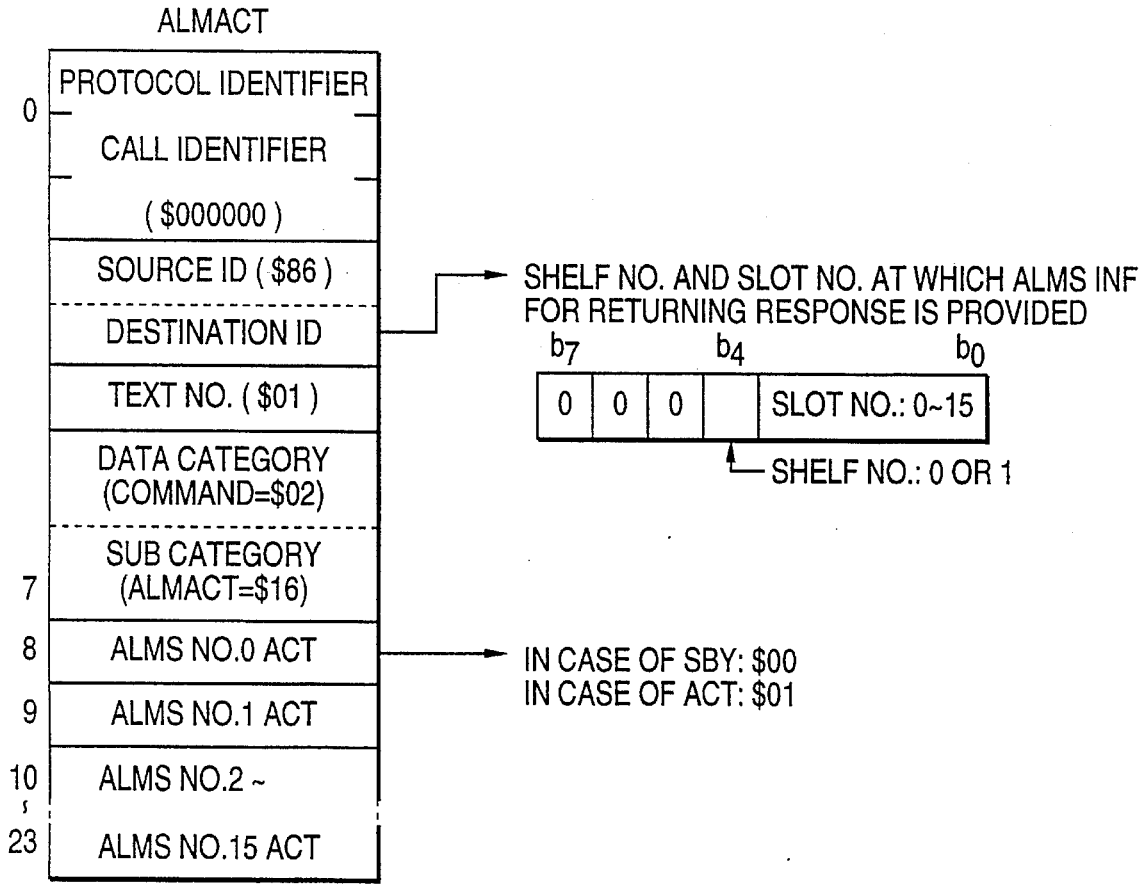
FIG. 11 is an example of a data format for an ALMACT order specifying a switching operation.

When the processor MPR 209 receives the above confirmation response CNF shown In FIG. 8, the MPR 209 outputs an ALMACT order to specify a switching operation of the system to the ALMS INF 300. The ALMACT order includes information as to whether 4 (four) CSEIs, namely 16 (sixteen) lines, are made to be in an active state or a standby state. FIG. 11 shows an example of the data format of the ALMACT order. The ALMACT order comprises 24 bytes and the shelf number and slot number of the corresponding ALMS INF 300 are written as the destination terminal. In this data format, the information as to whether the local office managed by the ALMS INF 300 is made to be in the standby or active state is written so that the line in the standby state corresponds to "00" and the line in the active state corresponds to "01", for example Accordingly, by inputting the order ALMACT to the ALRVSH-A 201, the line of the local office for making a connection with the ALMS INF 300 is set to the active state or standby state.

The ALMACT contains information for causing the statuses of four 4-CSEI cards (namely, 16 lines) to become active or inactive (standby). As shown in FIG. 7, the alarm link is duplexed. Each local office has two systems which are system 0 and system 1, each of which is linked to a corresponding ALMS INF 300. When the system 0 of each local office is used, the MPR 209 causes the line of the ALMS INF 300 of the system 0 to become active and the line of the other ALMS INF 300 of the system 1 to become inactive (in the standby status). Each ALMS INF 300 receives this order and sends a response CNF back to the MPR 209.

Under the above process, the MPR 209 executes the initialize process for the ALMS INF 300. After the initialize process is completed, the ALRVSH-A 201 periodically collects alarm information from the local offices accommodated therein, thereby starting an alarm polling process and stores the collected data. The ALRVSH-A 201 independently performs this alarm polling process.

Figure 12:
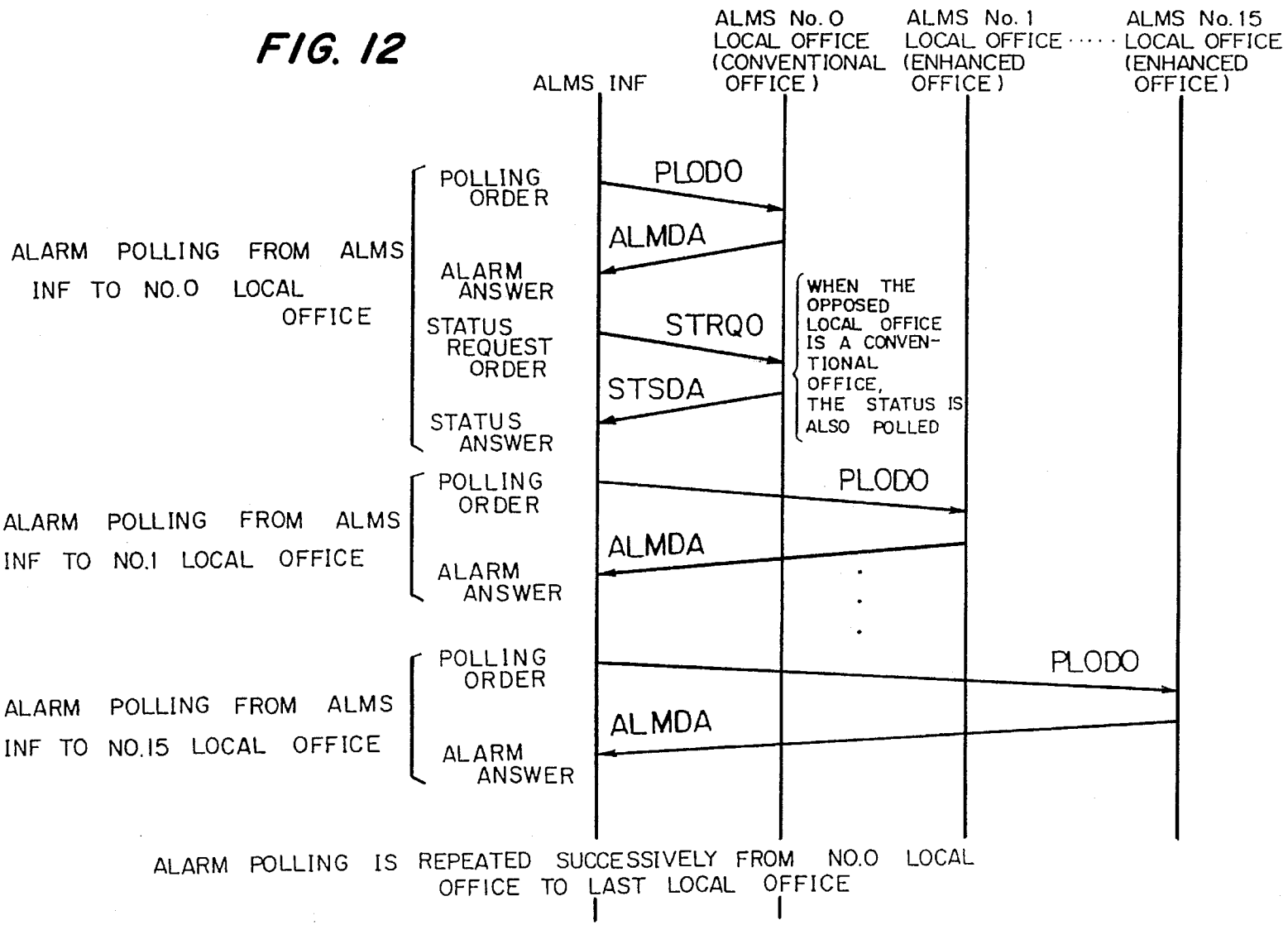
FIG. 12 is a timing chart of an alarm polling process.

FIG. 12 is a timing chart of the alarm polling process.

The ALMS INF 300 sends to up to 16 (sixteen) active local offices accommodated therein an alarm collection order in an ascending sequence, starting with No. 0, so as to poll information therefrom. The output control of the polling order is carried out in accordance with a program stored in ROM by MPU unit 430 in the corresponding ALMS INF 300. The MPU unit 430 recognizes based on the LCLID order output from the processor MPR 209 that up to 16 (sixteen) local offices subject to its maintenance are enhanced local offices 220 or conventional local offices 230. When a relevant local office is an enhanced office, the ALMS INF 300 sends to the office only an alarm information request polling order PLODO. The polling order PLODO is four bytes. When a relevant local office is a conventional office, the ALMS INF 300 sends to the office a status request order STRQO as well as the polling order PLODO. This is because an enhanced office sends edited data of alarm and status information back to the ALMS INF 300, whereas a conventional office does not perform the edit process. Thus, the ALMS INF 300 must separately collect alarm information and status information from the conventional office.

FIG. 13A is an example of a data format for the polling order PLODO when the above alarm polling is performed. The polling order PLODO comprises 4 (four) bytes. The polling order PLODO designates the local office using the ID code and contains the code "80" designating a request for alarm information. FIG. 13B is an example of a data format for the status request order STRQO when the above alarm polling is performed. The status request order STRQO comprises 3 bytes. The STRQO order designates the local office using the ID code and contains the code "81" for requesting the status information. The alarm polling consists of sequentially performing a polling operation of the local stations, 16 (sixteen) at maximum, in the active state, beginning with the local office No. 0 and ending with the local office No. 15, thereafter repeating the polling operation. The waiting time for the response to the polling instruction is determined to be 300 ms, and when a response to three consecutive polling instructions is not obtained, it is deemed that a communication error has occurred during data transmission to the local office.

When an enhanced office is polled according to the alarm information request polling order PLODO, the enhanced office sends alarm answer data ALMDA (FIG. 12) of 60 bytes back to the ALMS INF 300. The alarm answer data ALMDA contains various alarm information and status information which have been edited.

FIG. 14 shows an example of alarm answer data ALMDA output from an enhanced office 220. The alarm answer data ALMDA comprises 60 bytes. The alarm answer data ALMDA, which includes the ID number of the local office and alarm information or status Information in respective portions in the office is written after being edited. A 1-byte software alarm 1, a 1-byte hardware alarm 2 and a 1-byte software status information 3 are included in the edited information. The alarm answer data ALMDA output from the enhanced office 220 includes the software alarm 101, hardware alarm and software status information as the edited data as shown in FIG. 16A.

When a conventional office is polled according to the alarm information request polling order PLODO, it sends alarm answer data ALMDA of 32 bytes back to the ALMS INF 300. After the ALMS INF 300 receives the alarm newer data ALMDA, it sends a status information request order STRQO of three bytes to the conventional office. After the conventional office receives the order STRQO, it sends status answer data STSDA of 309 bytes back to the ALMS INF 300. Thereafter, the MPU 430 of the ALMS INF 300 converts the format of the ALMDA data and the STSDA data to the format of the ALMDA data of 60 bytes received from the enhanced office. Since part of the alarm information of the ALMDA data received from the conventional office has not been edited, alarm points need to be set and edited by using the received data.

FIG. 15 is an example of alarm answer data ALMDA format comprising 32 bytes transmitted from the conventional office. The alarm answer data ALMDA is non-edited alarm information in the case of the conventional office 230. The status request order STRQO is output to the conventional office 230 and the conventional office 230 outputs the status answer data STSDA comprising the 309 bytes, for example.

Figure 17:
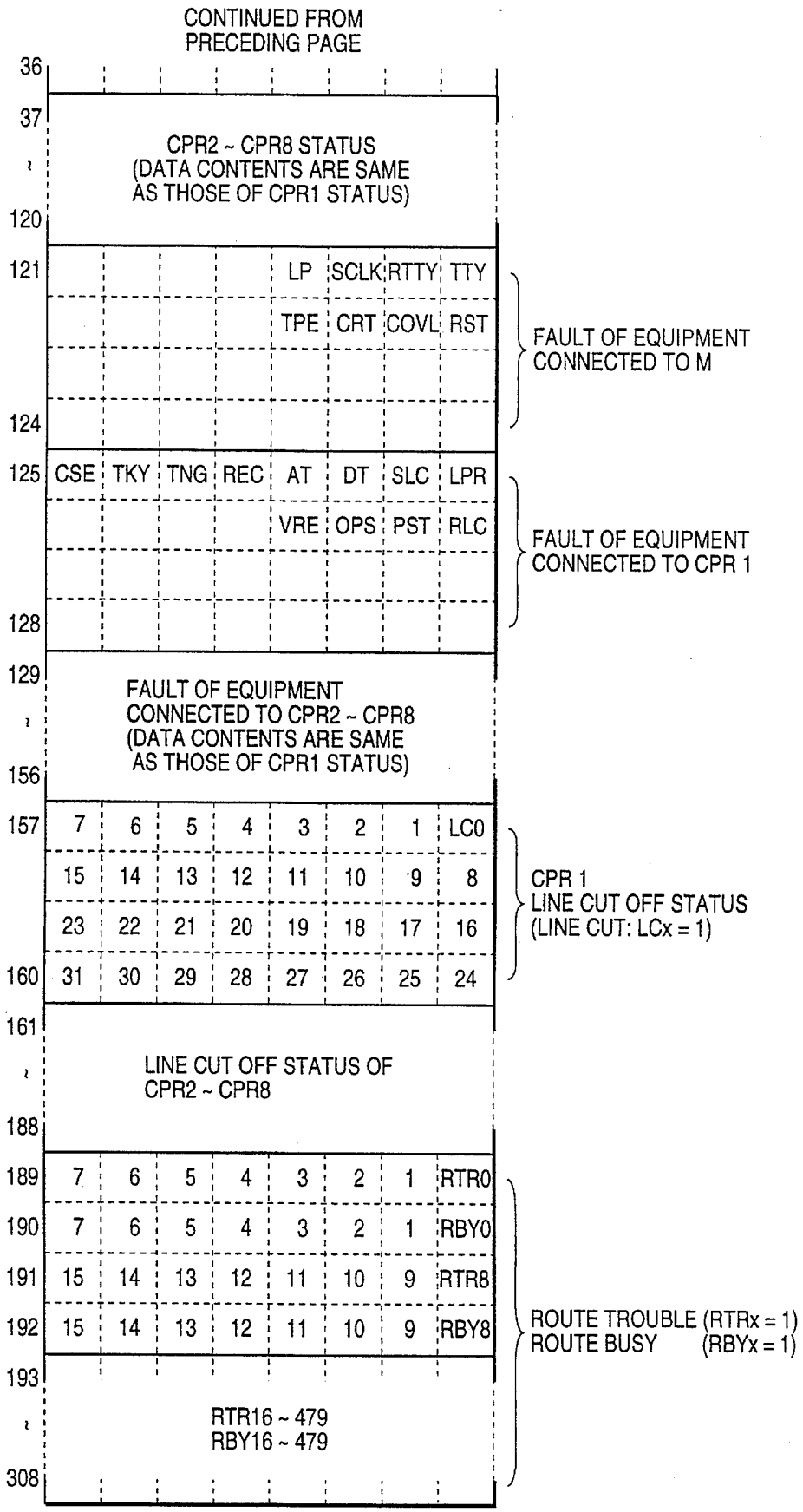
FIG. 17 is a continuation of FIG. 16 and shows an example of a data format of the status answer data STSDA from the conventional office.

FIGS. 16 and 17 are examples of the status answer data STSDA format having a 309-byte structure, which is sent from the conventional office.

The alarm answer data ALMDA output from the conventional office 230, as shown in FIG. 15, does not include the hardware alarm 2 and software status information 3, unlike the alarm answer data ALMDA outputted from the enhanced office 220, and only includes the software alarm 1. Therefore the ALMS INF 300 receiving the alarm answer data ALMDA and status answer data STSDA from the conventional office 230 edits both sets of data by using the MPU portion 430. The edited data must have the same form as the 60-byte alarm answer data ALMDA transmitted from the enhanced office 220.

Figure 18A:
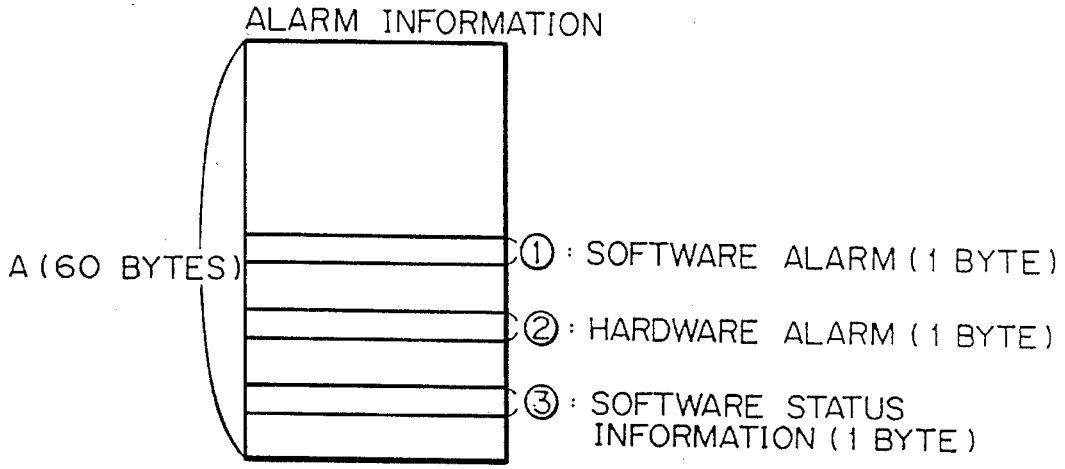
FIGS. 18A through 18C are explanatory views showing a sequence for data conversion of the alarm information from the conventional office to that from the enhanced office.
Figure 18B:
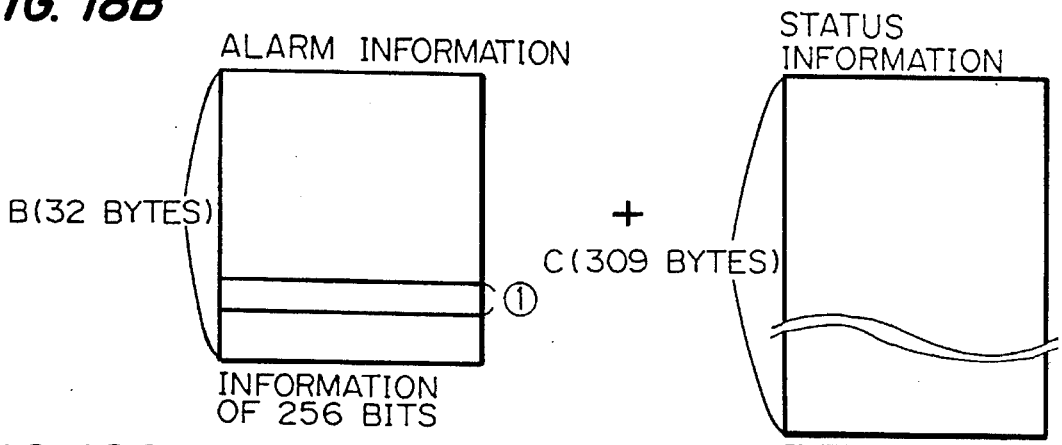
Figure 18C:
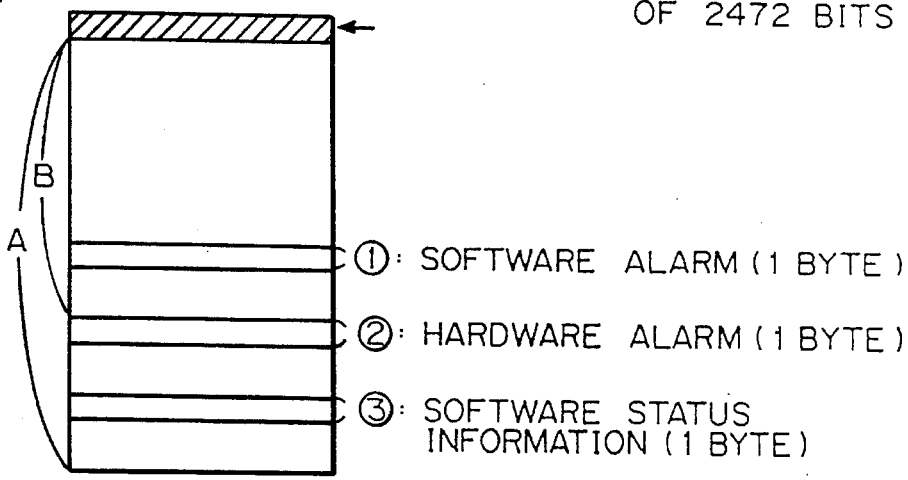

FIGS. 18A through 18C explain a sequence for forming the same data as the data from the enhanced office 220 based on the alarm answer data ALMDA and the status answer data STSDA transmitted from the conventional office 230.

MPU portion 430 prepares the edited information shown in FIG. 18A from the alarm information (alarm answer data ALMDA) and the status answer data STSDA.

FIG. 18B shows the information transmitted from the conventional office 230. The preparation of the edited information is performed by forming the hardware alarm 2 from the data (FIG. 14) of the alarm information ALMDA, and by forming the software status information 3 from the date of status answer data STSDA (FIGS. 16 and 17). The preparation of the edited data is executed based on a program written in the ROM in the MPU portion 430.

As shown in FIG. 14, the software status information 3 comprises 8 bytes. The MSB bit b7 represents "TPE", bit b6 "PRST", bit b5 "OSF", bit b4 "CCOL", bit b3 "CRT", bit b2 "LCO", bit b1 "RBY" and the LSB bit b0 "RTR".

Figure 19:
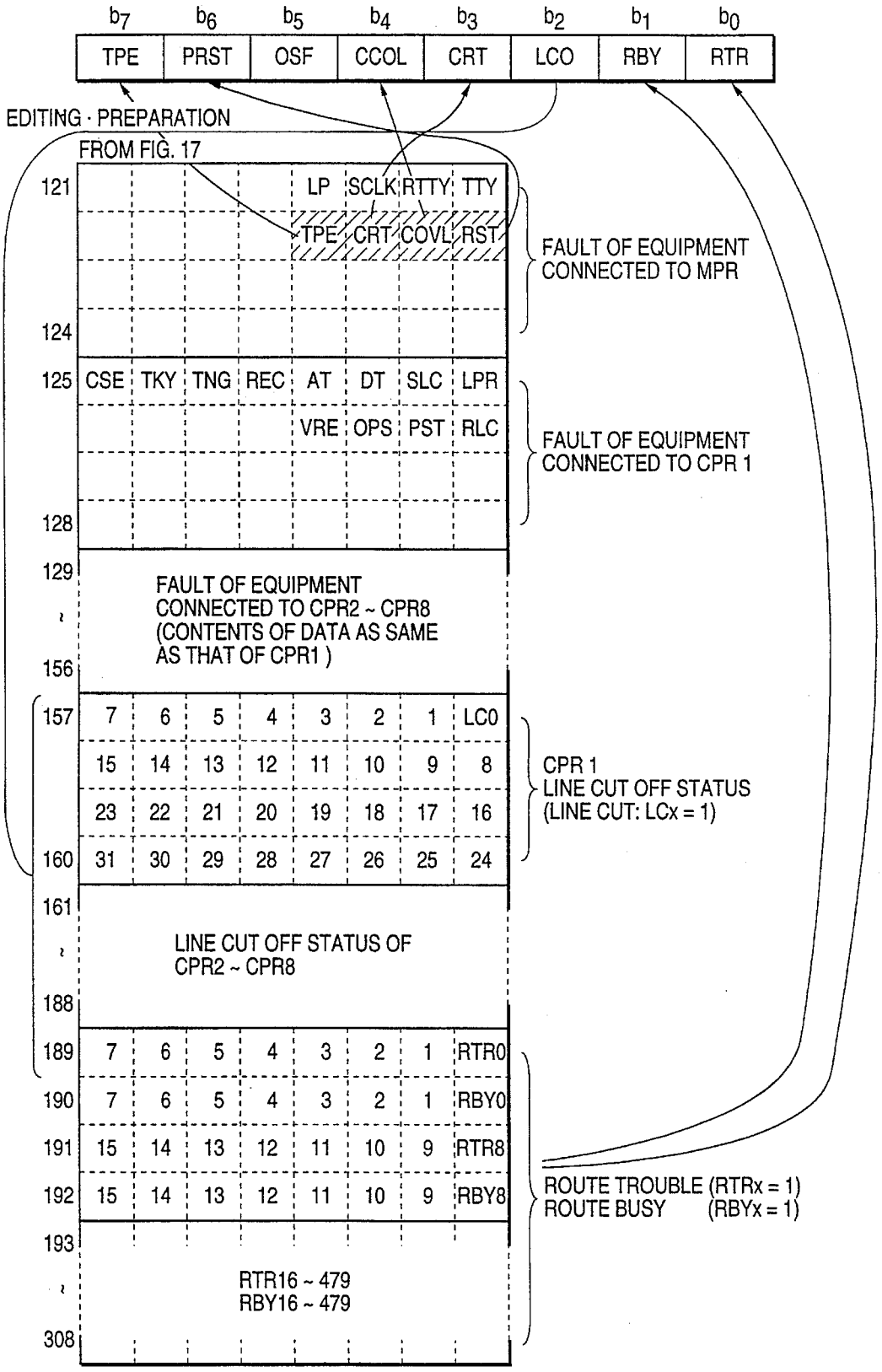
FIGS. 19 and 20 are explanatory views showing how software status information is obtained from that of the conventional status answer data STSDA.

As shown in FIG. 19, "TPE" (MSB bit b7) is prepared by copying "TPE" (bit b3) at the address 122 of the data of the status answer data STSDA (FIGS. 16 and 17). "PRST" (bit b6) is prepared by extracting "RST" (bit b0) at the same address 122 of the status answer data STSDA.

"CCOU" (bit b4) is prepared by extracting "COVL" (bit b1) at the address 122 of the status answer data STSDA (FIGS. 16 and 17).

"CRT" (bit b3) is prepared by copying "CRT" (bit b2) at the address 122 of the status answer data STSDA.

"LCO" (bit b2) is "1" when the "1" exists in "LCX" at at least one of addresses 157–188 of the status answer data STSDA and is "0" otherwise.

Further, "RBY" (bit b1) is "1" when the "RBY" bit is "1" at at least one of addresses 190, 192, 194 . . . 308 in the status answer data STSDA and is "0" otherwise.

Finally "RTR" (the LSB bit) is "1" if the "RTR" bit is "1" at at least one of addresses 189, 191, 193 . . . 307 of the status answer data STSDA and "0" otherwise.

Figure 20:
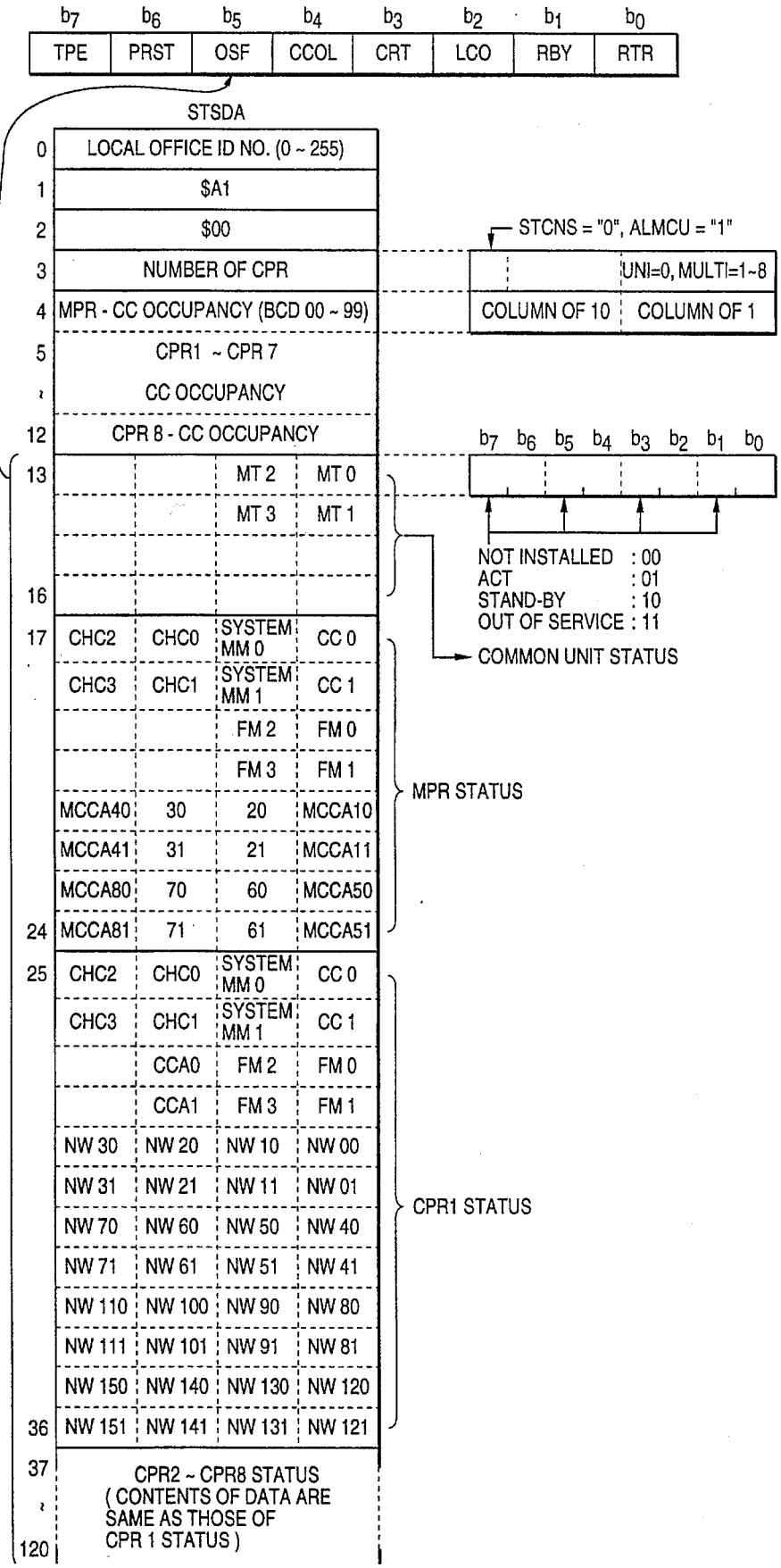

As shown in FIG. 20, "OSF" (bit b5) is "1" when the logical sum (OR) of the following conditions 1–3 is true and "0" when the logical sum is false. Condition 1 is true when the address of the data indicating "out of service" is one of the addresses 13–120 of the status answer data STSDA (FIGS. 16 and 17). Condition 2 is true when at least one of "LP", "SCLK", "RTTY" and "TTY" (bits b0–b3) of the addresses 121 of the status answer data STSDA (FIGS. 16 and 17) is "1". Condition 3 is true when the bit "1" exists at at least one of the addresses 125–156 in the status answer data STSDA. The blank portion is not considered.

As shown in FIG. 18C, the edited information thus prepared has the same structure as the alarm information (alarm answer data ALMDA) of the enhanced office shown in FIG. 18A.

The preparation of the hardware alarm 2 based on the alarm information will not be explained in detail but the hardware alarm 2 is prepared one bit at a time in the same way as described above.

The alarm information of the conventional (local) office 230 can be edited as shown in FIGS. 18B and 18C based on the hardware alarm 2, software status information 3 and software alarm 1 directly transmitted from the conventional office 230.

In addition, after the MPR 209 performs the initialize process, it executes the following normal mods processes. The MPR 209 periodically performs a supervisory process for errors which occur in the ALRVSH-A 201 and alarms received from local offices, a system switch process for the ALMS INFs 300 and the DLI INFs 301, and a status supervisory process for the ALDE 210 and the R-ALIPU 211. These processes are performed in such a way that the MPR 209 sends an order to each card which then sends a response back to the MPR 209. Even while the MPR 209 is in normal mode, it can change the ID information and so forth of each local office and switch the current system of the ALMS INF to the other system in the same manner as the initialize process shown in FIG. 8.

Figure 21:
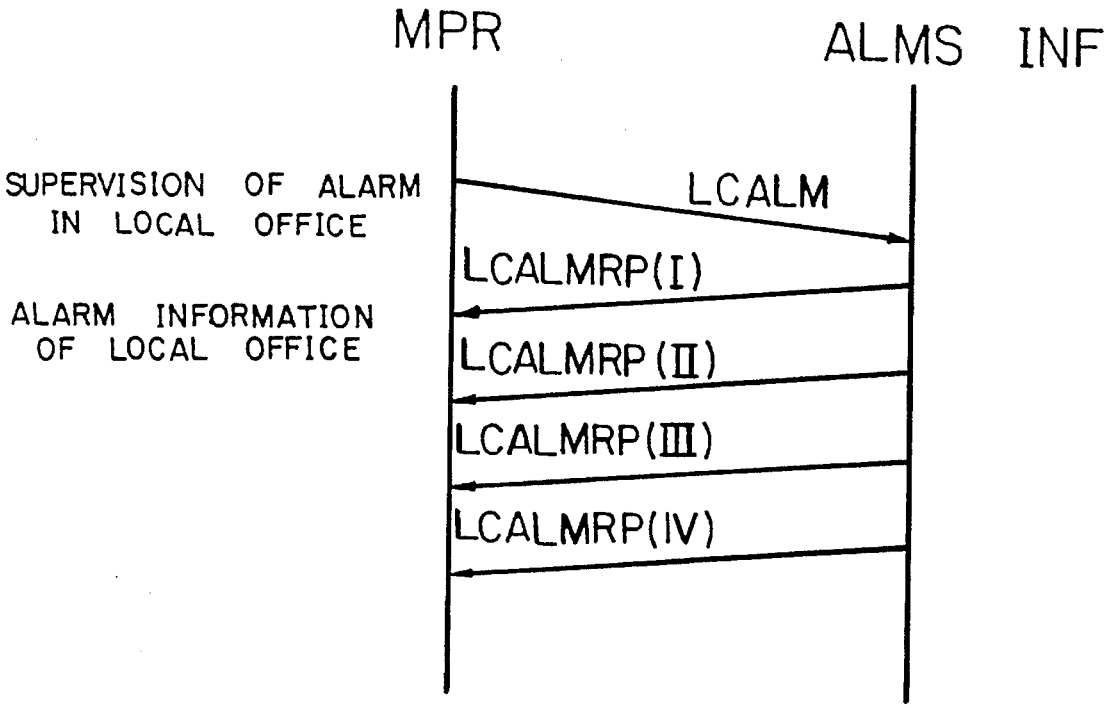
FIG. 21 is a timing chart of an alarm supervisory process performed by the main processor MPR.

FIG. 21 is a timing chart of an alarm supervisory process performed by the MPR 209.

The MPR 209 sends an alarm information request order LCALM to each ALMS INF card. After the ALMS INF card receives the alarm information request order LCALM, it sends alarm information LCALMPR back to the MPR 209.

Figure 22:
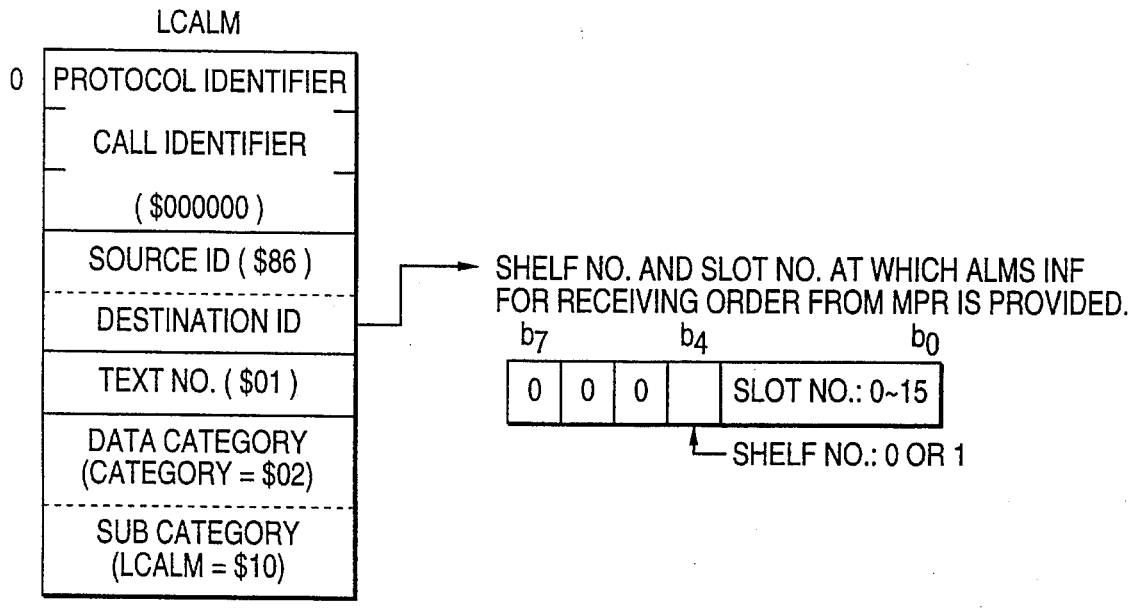
FIG. 22 shows an example of a data format of an alarm information request order LCALM.
Figure 23:
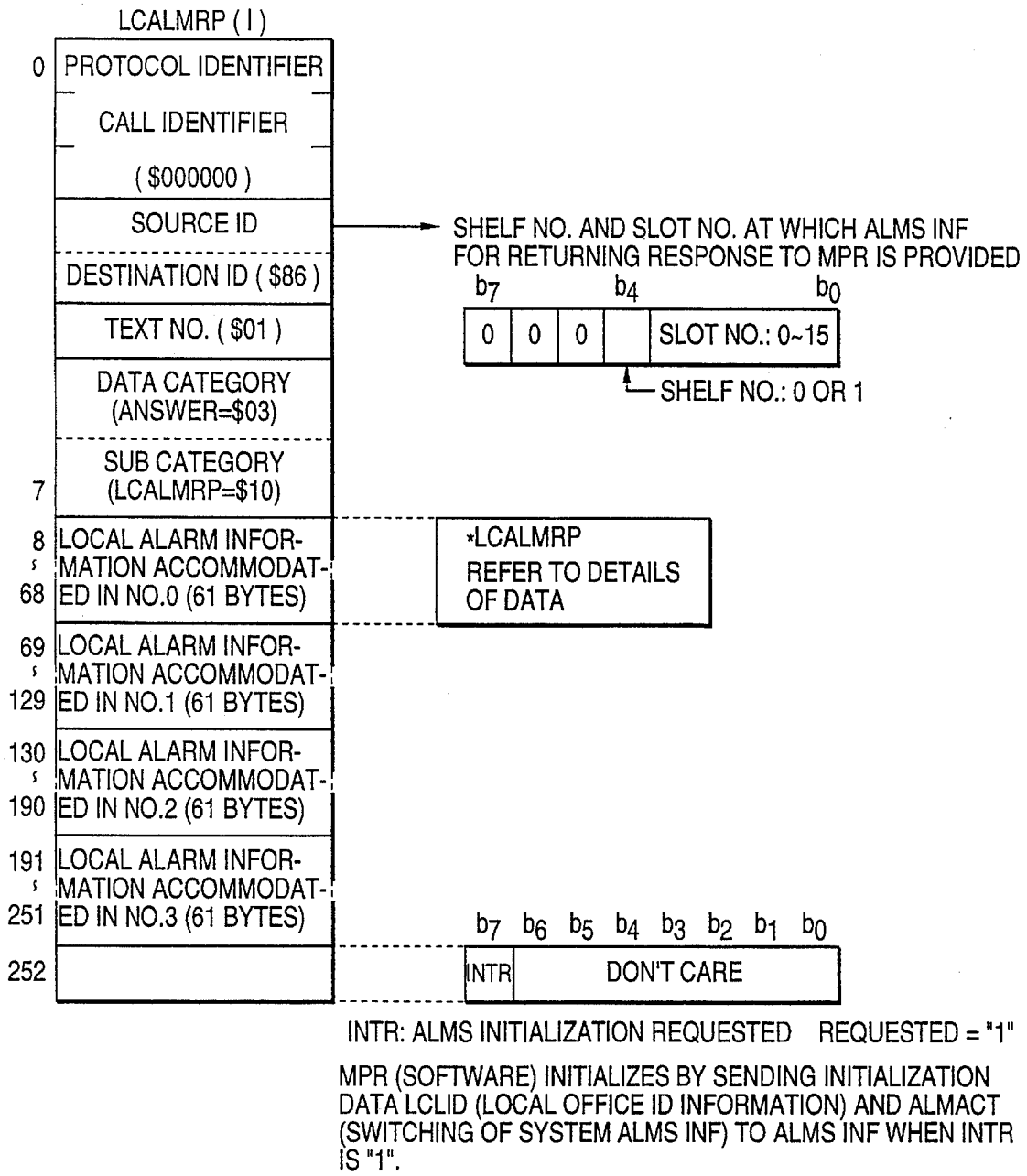
Figure 24:
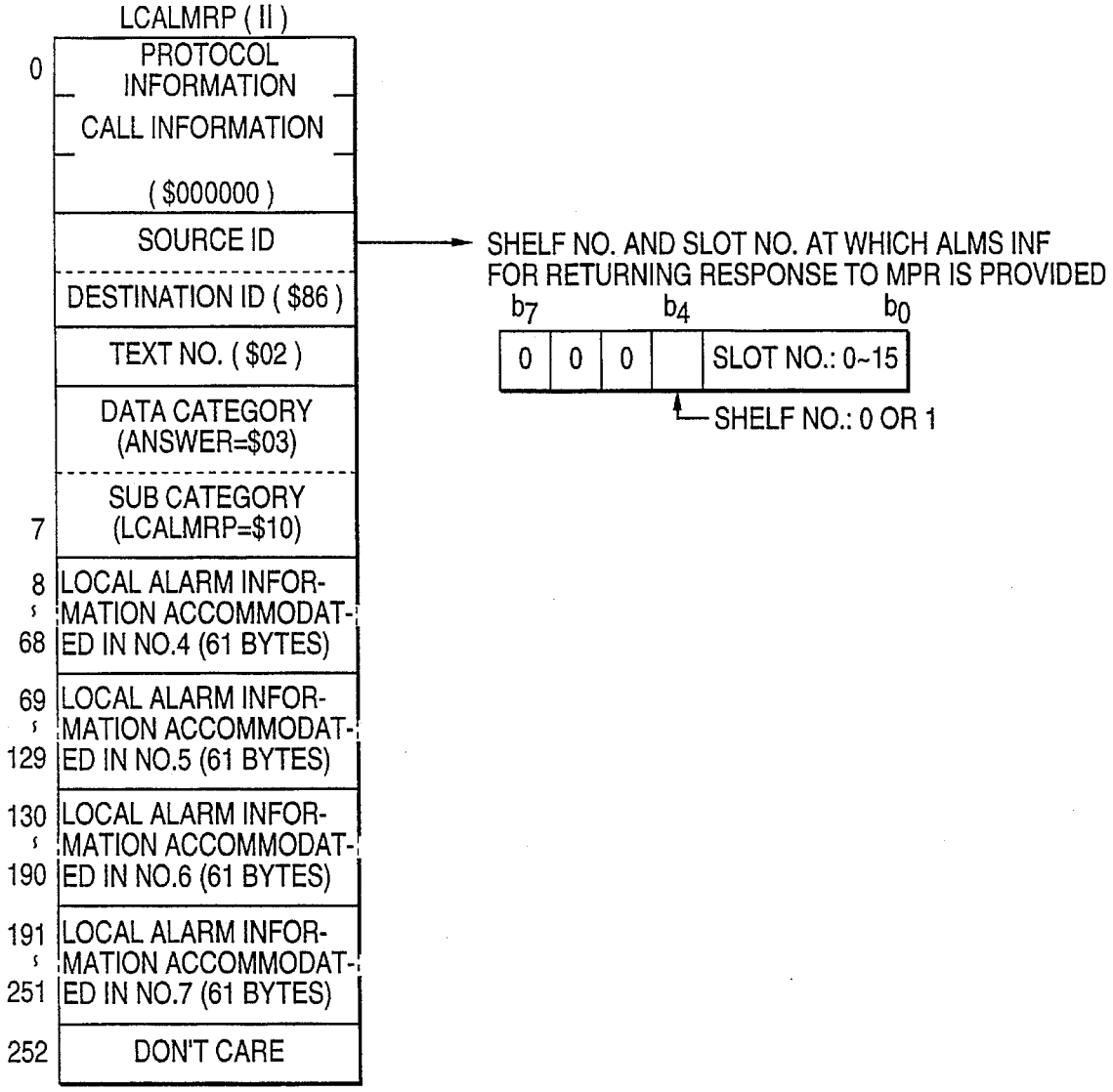
Figure 25:
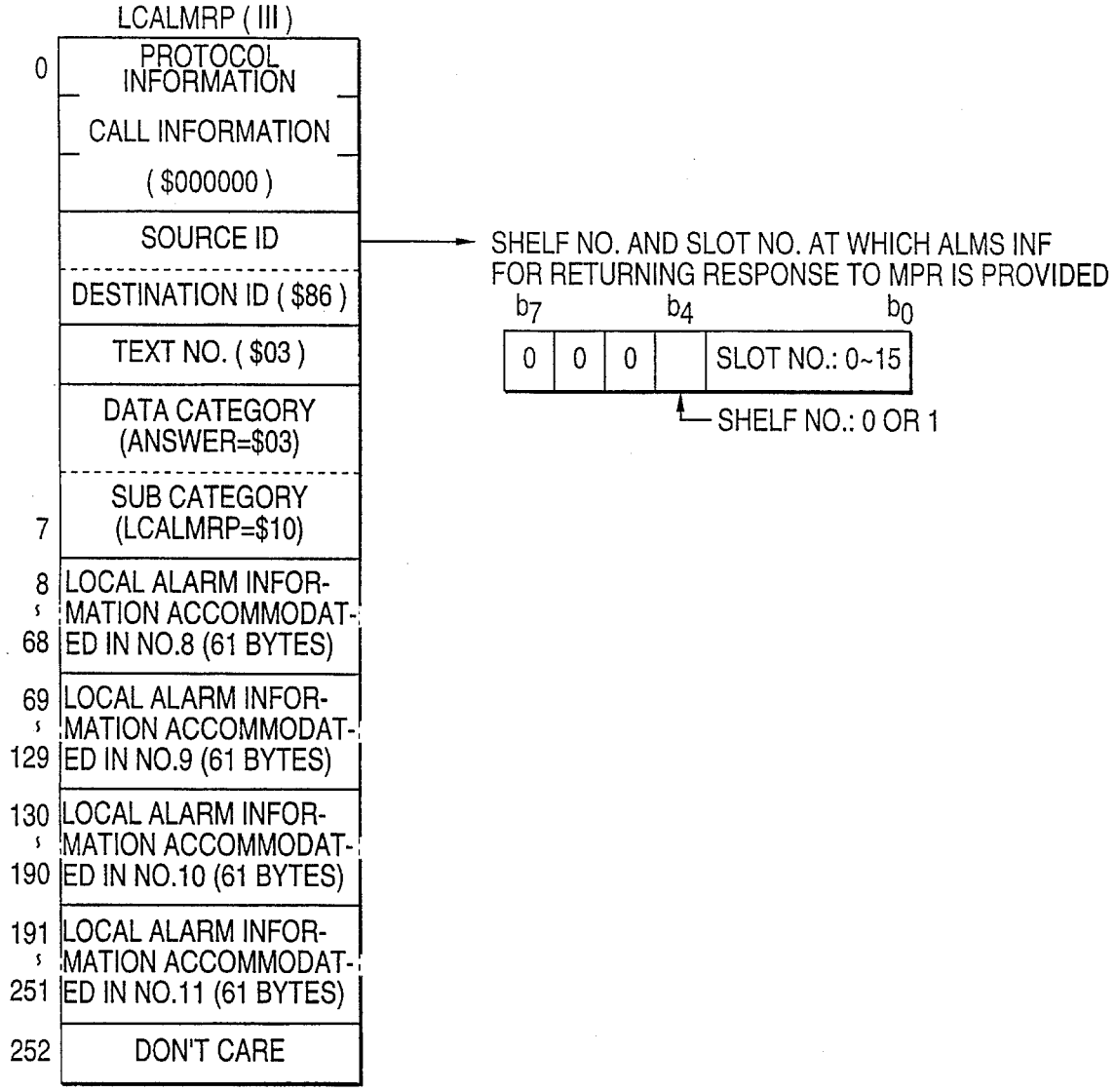
Figure 26:
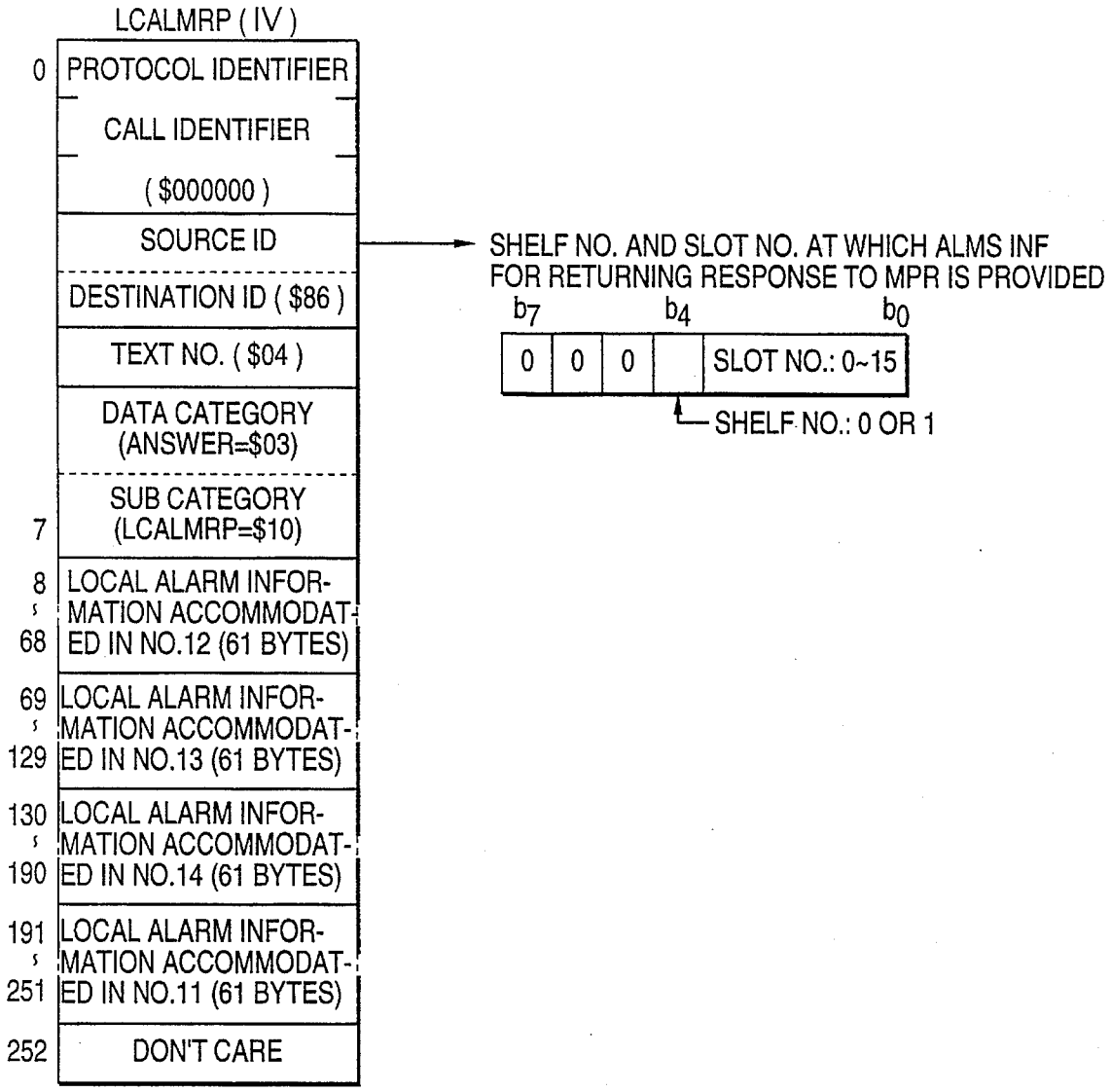

FIG. 22 shows an example of the data format of the alarm information request order LCALM. The LCALM comprises 8 bytes, including a protocol identifier in which an identifier for requesting alarm information is written, and a destination ID in which is written a shelf number and slot number specifying an ALMS INF to which the order is to be sent. Accordingly, the ALMS INF 300 specified by this shelf number and slot number receives the LCALM order.

The ALMS INF 300 which has received the LCALM order outputs the alarm information received from the local office to the main processor MPR 209. The output process is carried out under the control of the MPU portion 430. In particular, one ALMS INF 300 receives the alarm information from four CSEIs 205 and thus, the alarm information LCALMPR returned by the ALMS INF is transmitted four times as the alarm information of each of the local stations is transmitted (LCALMPR-1-4). FIGS. 23 through 26 show the data format of the alarm information LCALPMPR 1-4 returned by the ALMS INF. The alarm information of the local stations number 0 through number 3 is written in the format shown in FIG. 23; the alarm information of the local stations number 4 through number 7 is written in the data format shown in FIG. 24; the alarm information of local stations number 8 through number 11 is written in the data format shown in FIG. 25; and, the alarm information of local stations number 12 through number 15 is written in the data format shown in FIG. 26. The respective data formats comprise 253 bytes, which includes 61 bytes of alarm information for each respective local office. Specifically, the 253 bytes includes 244 bytes for 4 offices, or 61 bytes of alarm information per office, and 9 bytes of control signal data. The 9 bytes of control data include the source ID and destination ID.

The alarm information of 61 bytes for each local office is obtained by copying the alarm answer data ALMDA of 60 bytes received from an enhanced office by the ALMS INF. Alternatively, this alarm information is obtained by copying the 60-byte alarm and status answer data which has been received from a conventional office and edited by the ALMS INF.

MPR 209 further analyzes and edits the ALMS data LCALMPR and displays it on the SCWS 213.

On the other hand, usually, MPR 209 forms display information or buzzer information of R/ALIPU 211 by using the received alarm data LCALMPR and sending the received alarm data LCALMPR to ALRVSH-A201, thereby controlling the display or buzzer in the R-ALIPU INF 302. When communication with MPR 209 is interrupted (which is called stand-alone mode), R-ALIPU INF 302 requests local office alarm information from the ALMS INF 300, and ALMS INF 300 returns this information and R-ALIPU INF 302 controls the display and buzzer. Further, ALDE INF 210 periodically requests alarm information from the ALMS INF 300 to display the information of the local office on the map and performs the display process on the returned alarm information. By performing a process as described above, the alarm information obtained from enhanced office 220 and alarm information obtained from the conventional office 230 can be outputted to SCWS 213 in the same format and further if the number of the local stations increases, the number of ALMS INF 300 to be inserted in shelf 270 can increase.

FIG. 27 shows a block diagram of a system structure of an alarm collection apparatus in a concentration maintenance center according to a second embodiment of the present invention. The system of the second embodiment has a radio bass office 240 for notifying a moving communication control office of the position information of an automobile telephone or a portable telephone, for example, and transmits a call signal input from the moving communication control office to the local office of the first embodiment. In FIG. 27, a single radio base office 240 is shown but a plurality of radio base offices 240 are connected to central maintenance office CMOC 200 and the central maintenance office CMOC 200 controls a plurality of radio base offices 240. The radio base office 240 comprises supervision control unit (SV) 241 and an expanded multimedia multiplexer (EMPLX) 242. The system structure of the conventional office 230 is the same as that of the local office shown in FIG. 1A and the system structure of enhanced office 220 is the same as that of the enhanced local office shown in FIG. 1B. The connection between the radio base office 240 and central maintenance office CMOC 200 is performed via alarm link 261 and is connected to DLI 204 through DT 420 provided on the side of central maintenance office CMOC 200.

SV 241 in radio base office 240 collects an alarm in radio base office 240 and controls the display thereof. FIG. 28 shows a diagram of a system structure of SV 241 which comprises MPU (supervision control logic unit) 243, input and output control unit 244, communication control logic unit 247 and PC interface 248. MPU supervision control logic unit 243 is connected via a 64-bit bus 252 to input and output control unit 244, communication control logic unit 247, PC interface 248, and alarm unit 249. The MPU 243 supervises the operation of these circuits and the information obtained from these circuits is sent to the alarm unit 249. Alarm unit 249 displays the information by means of LEDs. MPU 243 stores contact information (alarm information) input through input and output control unit 244 and outputs the contact alarm to the central maintenance office CMOC 200 through PC interface 248. Communication control logic unit 247 converts the data request and control request from a parent machine, (for example, moving communication control office or radio line control office) to a suitable data format and notifies MPU 243 of the data request and control request in the case of the radio telephone.

Input and output control unit 244 supervises the supervision input unit 245 at a predetermined period, and receives contact information (alarm information), converted to the suitable data format by the observation input unit 245. PC interface 248 is connected to the central maintenance office CMOC 200 and converts data requests and control requests from the central maintenance office CMOC 200 into a suitable data format, thereby notifying the MPU 243 of data requests and control requests.

Power source unit 250 comprises a DC-DC converter and converts DC current to a predetermined DC voltage and telephone 251 converts between a voice signal and an electric signal and accesses the line. Input and output control unit 244 provides an instantaneous output regarding the contact information to control output unit 246 during a 200 millisecond interval. Input and output control unit 244, supervision input unit 245, control output unit 246 are connected by an 8-bit bus 253.

FIG. 29 shows a block diagram of a system structure within central maintenance office CMOC 200 wherein SV INF 400 is added to the package 271 shown in FIG. 3, SV INF 400 corresponding to the radio base office. SV INF 400 is connected to radio base office 240 such that alarm link 261 is connected to the radio base office DT on the side of central maintenance office CMOC 200 and further connected to DLI 204 and 4SVIPA 410. FIG. 29 shows a single SV INF 400 but a plurality of SV INFs 400 may be used to perform alarm maintenance of more than 16 (sixteen) radio base offices 240. SV INF 400 is inserted in the shelf 270 as a single package 271 as shown in FIG. 5A. Accordingly, as described above, when more than 16 (sixteen) radio base offices 240 are to be subjected to maintenance, the required number of SV INF 400 (packages 271) are inserted into the shelf 270.

The alarm collection operation of radio base office 240 will be explained below.

Before SV INF 400 performs the alarm collection process for radio base office 240, an initial process for setting the state of the radio base office 240 which is subject to the maintenance of SV INF 400 is performed through software by MPR 209. The process is the same as that performed for ALMS INF 300 and is executed in accordance with the flowchart shown in FIG. 30. The processor MPR 209 outputs the SVADR order for initializing the radio bass office 244 which is in charge of the SV INY 400 inserted in ALRVSH-A 201. FIG. 31 shows an example of the data format of this SVADR order comprising 440 bytes and a protocol identifier source ID, destination ID, text number data category, subcategory and SV (radio base office 240) No. 0 to No. 15 in a manner similar to the above described LCLID order. The identifier designating that the data format comprises a SVADR order is supplied as the protocol identifier and the shelf number and slot number of the SV INF 400 of the corresponding destination terminal are supplied as the destination ID.

Based on the SV (radio base office 240) No. 0 to No. 15, the number and the position of the radio base office 240 which is subject to the maintenance by SV INF 400 are determined. Therefore, SV INF 400 can determine the number and position of the radio base offices in its charge in a manner similar to the above-described ALMS INF 300.

On the other hand, the SV INF 400 which receives an SV ADR order returns a confirmation response CNF indicating the receipt of the SV ADR order to MPR 209. The data format of the confirmation response CNF is the same as that shown in FIG. 10. The shelf number and the slot number of the corresponding SV INF 400 are output as the source ID.

Next, when processor MPR 209 receives confirmation response CNF, it outputs a SVIFAT order to perform a switching of the SV INF system 400 as shown in FIG. 32. The shelf number and slot number of the corresponding SV INF 400 are written in the destination ID in the SVIFAT order and S, thereby setting the radio base office 240 controlled by SV INF 400 to a standby state or an active state. When SV INF 400 receives the order, it returns the response CNF to processor MPR 209. Processor MPR 209 can recognize, based on the input of the confirmation response CNF, that the process of setting an active state or standby state of the line communicating with the radio base office 240 is completed.

When the initialization process of SV INF 400 is completed by the above stated process which is performed by processor MPR 209, ALRVSH-A 201 periodically collects alarm information from the radio bass office which is subject to a maintenance and supervision by MPR and performs an alarm polling process to store the collected data.

FIG. 33 is a timing chart of the alarm polling process. In the case of radio base office 240, there is no distinction between the enhanced office and conventional office unlike the previous embodiment and the apparatus SV INF 400 for collecting alarm information outputs only a POPLO order for collecting the alarm to the corresponding radio base office, thereby repeating the sequential polling. The output control of the POPLO order is performed by MPU in the corresponding SV INF 400. This alarm polling is performed by sending the POPLO order to 16 (sixteen) active radio base offices at maximum which are subject to the maintenance starting with the radio base office No. 0, thereby repeating the polling operation. The response waiting period for the polling instruction is set to 300 ms and when the response is not obtained for 3 consecutive polling instructions, an error in communication with radio base office 240 is deemed to have occurred.

The alarm answer data SVRL is output from a radio base office 240 having an alarm based on the above POPLO order, and NO DATA is output from a radio bass office 240 which does not have any alarms. The alarm answer data SVRLT output from the radio bass office 240 does not include any difference between the enhanced office and the conventional office unlike in the previous embodiment, and the SV INF 400 need not perform the editing process as described above.

Thereafter MPR 209 outputs an order requesting the alarm information from respective SV INFs 400 which have received the request and these return the alarm information LCALMPR. The format and time chart of this order is the same as that shown in FIG. 21. The shelf number and slot number in which the SV INF 400 for sending the order is installed is outputted as the destination ID and the alarm information is received from the corresponding SV INF 400. More particularly, the alarm information is received from a single SV INF 400 with regard to four radio base offices in such a manner that the alarm information is divided into four.

FIG. 34A explains the meaning of the order code POLO which requests alarm information from SV. FIG. 34B shows the data format of the POLO order which includes a source address, a destination address, data length and the data itself.

FIG. 35A explains the meaning of the SVRLT response representing the result of the observation received from the SV. FIG. 35B shows the data format of the SVRLT response which indicates a communication identifier, source address, destination address, data length and the data itself. FIG. 35C shows the result of the supervision comprising the items 1 to 127. The examples of the items such as water leak (item 1), door open (item 2), working (item 3) and operation/stop (item 4) are shown in FIG. 36. The supervision result will be returned to SV INF from the SV as the response date so that the SV INF can collect the alarm information from the radio base office.

The MPR 209 can further analyze and edit the alarm data LCALMPR being received so as to display the resultant data on the SCWS 213.

Normally, the MPR 209 displays the received alarm data LCALMPR on the R-ALIPU 211 and creates buzzer information. Thereafter, the MPR 209 sends the created information to the ALRVSH-A 201. Thus, the ALRVSH-A 201 displays the information on the R-ALIPU INF 302 and performs a buzzer control process.

By performing the process as described above the central maintenance office CMOC 200 can also perform maintenance and management to collect the alarm from the radio base office 240. Thus, the present embodiment can handle the increase in the number of the radio base offices 240 likely to occur in the near future.

The number of alarm information collection cards ALMS INF 300 which are accommodated in the ALRVSH-A 201 can be increased. Thus, the apparatus can flexibly handle an increase of the number of local offices from which alarms are collected.

Further, the software of the MPR can display the errors on the screen of the workstation SCW, thereby achieving an advanced man-machine interface. Further the function of ALMS INF can deal with both the conventional office and the enhanced office and absorb the difference between the two offices.

By performing maintenance and management of the alarms by treating the radio base office as one of the local offices the present invention can flexibly deal with radio base offices the number of which is expected to increase, for example, automobile telephone and portable telephones.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. An alarm collection apparatus for use in an exchange system, comprising:

a central maintenance office;

a toll switch;

a plurality of local offices, including an enhanced local office and a conventional local office, connected to said central maintenance office through said toll switch, said enhanced local office and said conventional local office providing alarms;

an alarm link connecting the alarms in said enhanced local office and said conventional local office to the central maintenance office;

an alarm collection shelf provided in said central maintenance office to collect alarm information received through said alarm link from said enhanced local office and said conventional local office and to convert alarm information from said enhanced local office and said conventional local office to alarm information having same format to accommodate the plurality of local offices providing differently formatted alarm information; and means, connected to said alarm collection shelf, for performing an initial setting of said alarm collection shelf, and for performing editing and display of the collected alarm information.

2. An alarm collection apparatus as recited in claim 1, wherein said alarm collection shelf comprises a plurality of communication interface cards for interfacing with said plurality of local offices.

3. An alarm collection apparatus as recited in claim 2, wherein said communication interface cards are inserted into a shelf structure, and a number of local offices which may be interfaced with is increased by increasing a number of interface cards inserted into the shelf.

4. An alarm collection apparatus as recited in claim 1, wherein said alarm collection shelf absorbs a difference in types and formats of information sent from the enhanced local office and the conventional local office, and converts the information from the conventional local office to a format of that of the enhanced local office, and manages both the enhanced local office and the conventional local office.

5. An alarm collection apparatus as recited in claim 1, wherein said initial setting means performs an initial setting of the alarm collection shelf and performs editing and display of the alarm information through a flexible man-machine interface.

6. An alarm collection apparatus for use in an exchange system, comprising:

a central maintenance office;

a toll switch;

a plurality of local offices, said plurality of local offices including, an enhanced local office having an enhanced number of points from which alarms are collected, a display function and a man-machine interface, a conventional local office, and a communication radio base office, wherein said enhanced local office and said conventional local office are connected to the central maintenance office through said toll switch;

an alarm collection shelf, provided in the central maintenance office, to collect alarm information from the enhanced local office, from the conventional local office and from the radio base office and to convert alarm information from said enhanced local office, said conventional local office and said communication radio base office to alarm information having same format to accommodate said enhanced local office, said conventional local office and said communication radio base office providing differently formatted alarm information; and means, connected to said alarm collection shelf, for performing an initial setting of the alarm collection shelf and for performing editing and display of the alarm information.

7. An alarm collection apparatus as recited in claim 6, wherein said alarm collection shelf absorbs differences in types and formats of information received from said enhanced local office and said conventional local office, with respect to alarm information and system status information received from local offices, and converts a format of information received from said conventional local office into a format of information received from said enhanced local office to control a plurality of local offices including said enhanced local office and said conventional local office.

8. An alarm collection apparatus as recited in claim 6, wherein said alarm collection shelf comprises a plurality of communication interface cards for interfacing with a plurality of radio base offices.

9. An alarm collection apparatus as recited in claim 8, wherein said communication interface cards are inserted in a shelf structure, and the number of local offices which may be interfaced with is increased by increasing the number of interface cards inserted into the shelf.

10. An alarm collection apparatus for use in an exchange system, comprising:

at least one mobile radio base office to provide alarm information having different formats;

an alarm collection shelf to collect an alarm from said at least one mobile radio base office and to convert the alarm information having different formats to alarm information having same format to accommodate said at least one mobile radio base office providing differently formatted alarm information; and means for performing an initial setting of said alarm collection shelf, and for editing and displaying collected alarm information.

11. An alarm collection apparatus as recited in claim 10, wherein said alarm collecting shelf comprises plurality of communication interface cards for interfacing with a plurality of mobile radio base offices.

12. An alarm collection apparatus as recited in claim 10, wherein said initial setting means performs an initial setting of the alarm collection shelf, and an operation of editing and display of the alarm information through a flexible man-machine interface.

* * * * *

UNITED STATES PATENT AND TRADEMARK OFFICE

CERTIFICATE OF CORRECTION

PATENT NO. : 5,572,189

DATED : November 5, 1996

INVENTOR(S) : Kunio YAMAMOTO, et al

It is certified that error appears in the above-indentified patent and that said Letters Patent is hereby corrected as shown below:

Column 2

Line 56, change "δ" to --B--.

Column 11

Line 67, change "for example" to -- for example. --

Column 14

Line 12, change "CCOU" to -- CCOL--

Signed and Sealed this

Fourth Day of March, 1997

Bruce Lehman

*Attest:*

BRUCE LEHMAN

*Attesting Officer*

*Commissioner of Patents and Trademarks*